US007245223B2

(12) United States Patent
Trela

(10) Patent No.: US 7,245,223 B2
(45) Date of Patent: Jul. 17, 2007

(54) ANTI TERRORIST AND HOMELAND SECURITY PUBLIC SAFETY WARNING SYSTEM

(76) Inventor: Richard Steven Trela, 100 Pierce St. #1101, Clearwater, FL (US) 33756

( * ) Notice: Subject to any disclaimer, the term of this patent is extended or adjusted under 35 U.S.C. 154(b) by 697 days.

(21) Appl. No.: 10/720,043

(22) Filed: Nov. 20, 2003

(65) Prior Publication Data

US 2005/0190061 A1 Sep. 1, 2005

Related U.S. Application Data

(60) Provisional application No. 60/427,717, filed on Nov. 20, 2002.

(51) Int. Cl.
*G08B 23/00* (2006.01)

(52) U.S. Cl. ..... 340/573.1; 340/539.1; 340/691.6; 379/45; 455/404.1

(58) Field of Classification Search ..... 340/540, 340/539.1, 573.1, 693.1, 691.6, 531; 709/206–207; 348/143; 379/37, 45; 455/404.1, 404.2
See application file for complete search history.

(56) References Cited

U.S. PATENT DOCUMENTS 4,951,308 A * 8/1990 Bishop et al. ..... 379/91.01
5,793,851 A * 8/1998 Albertson ..... 379/144.01
5,850,599 A * 12/1998 Seiderman ..... 455/404.1
6,738,808 B1 * 5/2004 Zellner et al. ..... 709/223
7,092,695 B1 * 8/2006 Boling et al. ..... 455/404.1

* cited by examiner

*Primary Examiner*—Thomas Mullen

(57) ABSTRACT

An anti-terrorist and crime fighting system, method and apparatus, of isolating terrorists and criminals by providing a predetermined audio-visual stimulus into controlled public or private environments in order to elicit specific human responses, reactions and judgment changes in terrorists or other criminals. This stimuli is further utilized to create multiple stimuli points in the controlled environment by the dissemination of real-time intelligence being shown to the general public. This action creates further observable judgment changes in the terrorists and criminals as the general public become more aware of their environment and the people in it. The suspicious reactions are monitored by the general public as well as by onsite and behind the scenes security personnel via a real time camera system. The audio visual stimulus is provided by the nation's most active intelligence agencies in real time, which further stimulates terrorists or criminals into manifesting suspicious or guarded-judgment or physical action-changes, due to the uncertainty of what new information may be displayed next. This also serves as a continued interest point for the general public because of it's ever-changing nature of the information. Provided in the system is a method of making "one touch" e-911 call or terrorist hotline call via a specially designed emergency communication device. The system enables highly populated areas to be stimulated strategically in order isolate terrorists amongst the general public in high risk public places such as, airports, borders, public buildings, courthouses, hotels, sports events and other such high risk targets to potential terrorists. The system can also be utilized to quickly disseminate Amber Alerts across the nation.

2 Claims, 37 Drawing Sheets

Figure 1:
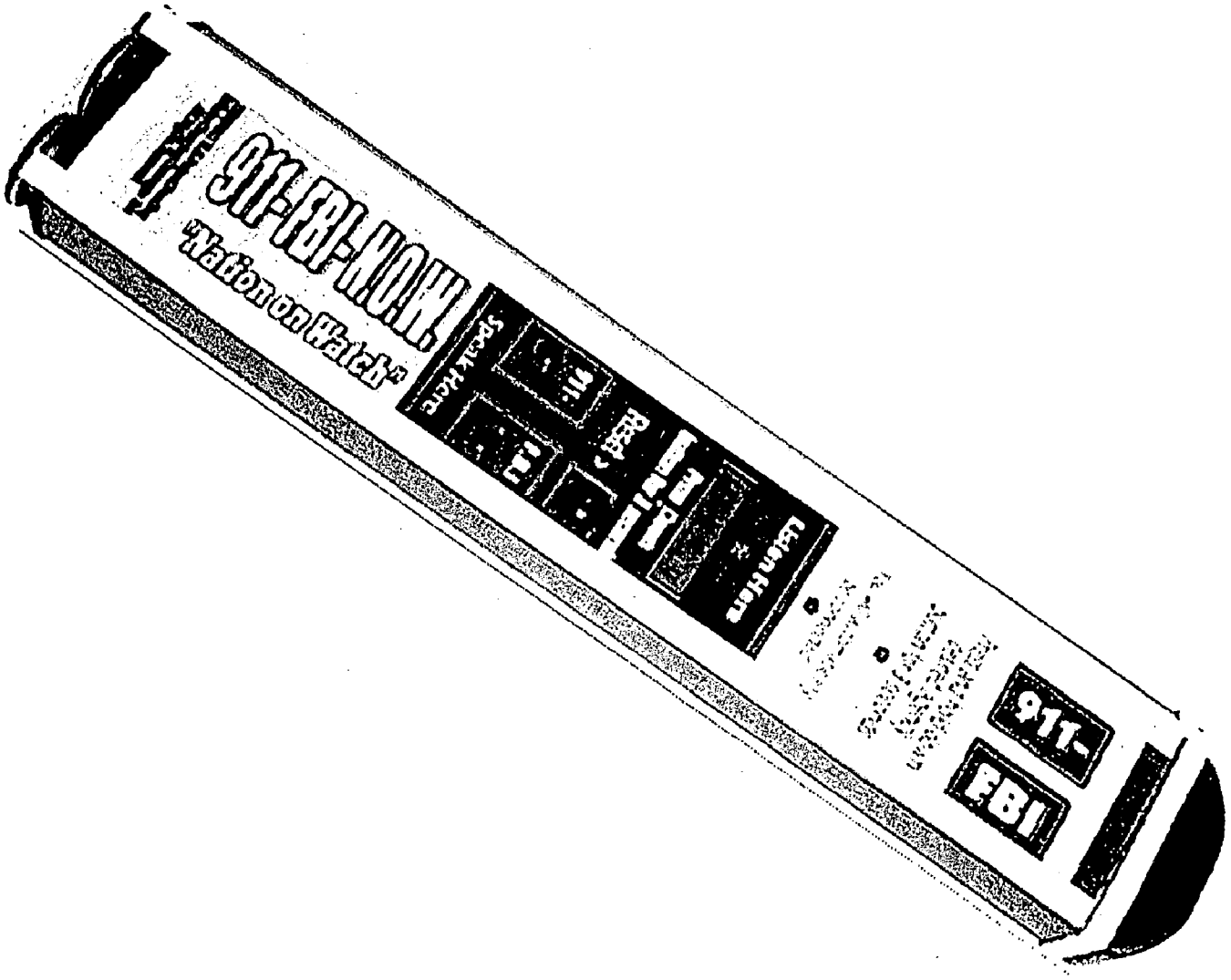

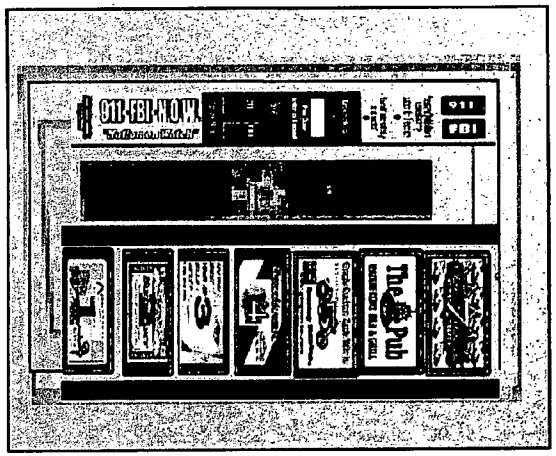
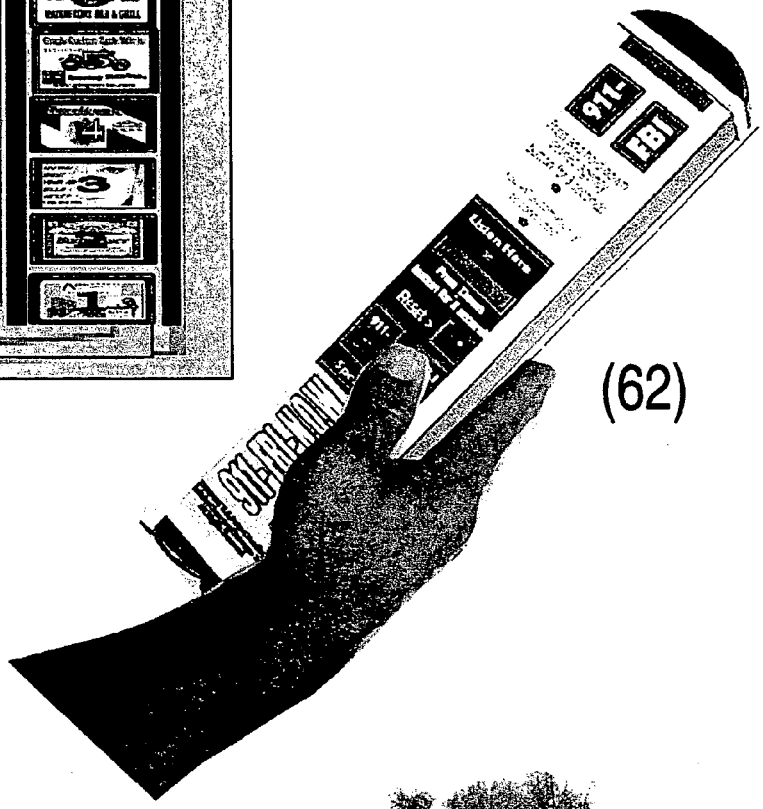
(62)
(63)
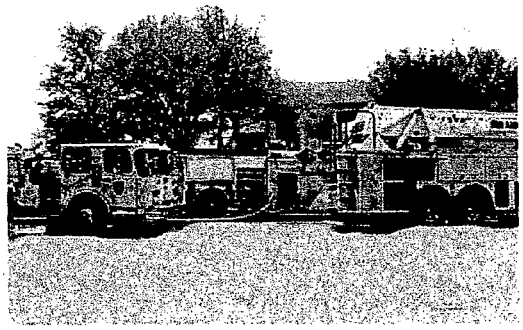
Figure 18

Intelligence Sources

*The Terrorist Response Alert Program (TRAP) provides participating agencies a means to immediately disseminate information vital to Homeland Security to our Nation's airports where further security action can be taken as needed.*

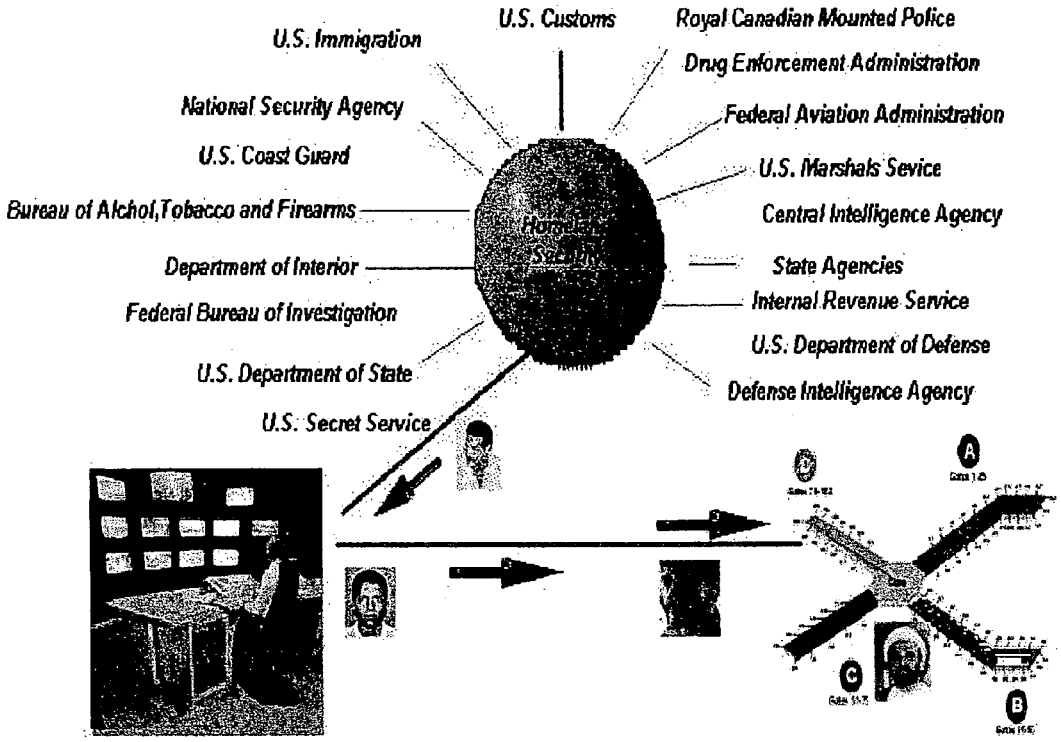

*The TRAP processing center eletronically relays vital Homeland Security information out to our nation's airports.*

Figure 26

ANTI TERRORIST AND HOMELAND SECURITY PUBLIC SAFETY WARNING SYSTEM

CROSS REFERENCE TO RELATED APPLICATIONS

Application Ser. No. 60/427,717 filed Nov. 20, 2002.

STATEMENT REGARDING FEDERALLY SPONSORED RESEARCH AND DEVELOPMENT

Not Applicable

REFERENCES CITED [REFERENCED BY]

| U.S. Patent Documents | | | |
|---|---|---|---|
| 4260980 | April 1981 | Bates | 340/32. |
| 4694295 | September 1987 | Miller et al. | 340/903. |
| 5027104 | June 1991 | Reid | 340/426. |
| 5280555 | January 1994 | Ainsburg | 385/116. |
| 5307136 | April 1994 | Saneyoshi | 356/1. |
| 5355118 | October 1994 | Fukuhara | 340/435. |
| 5424952 | June 1995 | Asayama | 364/443. |
| 5430431 | July 1995 | Nelson | 340/434. |
| 5530421 | June 1996 | Marshall et al. | 340/435. |
| 5570127 | October 1996 | Schmidt | 348/148. |

FIELD OF THE INVENTION

This invention relates generally to anti-terrorist, criminal exposure and law enforcement intelligence gathering, sharing and distribution systems.

BACKGROUND AND DESCRIPTION OF THE RELATED ART

While airline hijackings have occurred on several occasions in the past, it was not until the events of Sep. 11, 2001 that the potential use of such aircraft for mass destruction was seen by most people. While boarding checks and other security measures have been in place for many years, the events of September 11 have driven home the point that it is possible for potential terrorists to get past normal security measures and get on board planes or past security check points into public places with could potentially become targets of terrorists. The present invention provides a variety of advantages over earlier systems of by a new combination of technologies to bring about a much more effective system of achieving Homeland Security than has been seen before been available to Law enforcement and the nations public.

REFERENCES

"We need to find ways to share as much information with individuals as possible. To make every American whether they're in business, in industry or in law enforcement, or in their families, capable of enhancing their security by being aware and alert. So it's with that in mind, that we will guide our approach to information sharing. To make it possible for us all to be a part of the team which defeats terror".

"September 11 changed America forever. Since that day, people across the country have asked, "What can I do to help? What do I need to do to make my community, my family better prepared?" President Bush created Citizen Corps to answer those questions. Citizen Corps is a local, community-based initiative to have every American become active participants in the Homeland security effort and in support of local first responders and emergency managers."

As we look back and remember the tragic events of September 11, during this anniversary time, we also look forward. We can honor those lost by better and more creatively preparing for the future and taking the necessary steps to be better prepared for all disasters."

America is no longer protected by vast oceans. And as government works to better secure our homeland, America will continue to depend on the eyes and ears of alert citizens. We are protected from attack only by vigorous action abroad, and increased vigilance at home. State of the union address Jan. 2, 2002 address. And as government works to better secure our homeland, America will continue to depend on the eyes and ears of alert citizens.

In the aftermath of Sep. 11, 2001, the need for strengthening and securing our communities have become even more critical. President Bush has announced that, with the help of the National Sheriffs' Association, the Neighborhood Watch Program will be taking on a new significance. Community residents will be provided with information which will enable them to recognize signs of potential terrorist activity, and to know how to report that activity, making these residents a critical element in the detection, prevention and disruption of terrorism.

President Bush

"The threats that we have heard recently remind us of the pattern of threats we heard prior to September the 11. We have no specific threat to America, but we're taking everything seriously, obviously. And so, therefore, we have gone to a different level of concern, a different threat level, which means our government will be providing extra security at key facilities, and that we'll be increasing surveillance," said the President.*

The purpose of this system will be to raise awareness in the public that a real threat still exists in this country. Complacency since the events of September 11 are evident, and by keeping this threat in front of the general public will hopefully assist in preventing another tragedy such as that one.

"Fewer than one in four Americans (22 percent) in the latest FOX News/Opinion Dynamics national survey answered correctly when asked to name the country's current alert level—As the country continues to fight the war on terrorism, tracking down Al Qaeda members and other terrorists is the goal considered "very important" by the highest number of Americans"

Dana Blanton—Fox News—Jul. 12, 2002

By keeping the Homeland Security Advisory System in front of the public, as well as up to date information regarding wanted terrorists, amber alerts, and emergency information; it could help prevent future tragedies as well as aid in the capture of known or suspected terrorists "Seventy-three percent of Americans in an ABCNEWS/Washington Post poll express concern about the chance of further attacks. And 54 percent have little confidence in the government's ability to stop them"

ABC News—Jul. 16, 2002

Because this system can be updated on an almost instantaneous basis, and that information presented in front of large amounts of people at a time, the general public will be more informed and better prepared in the event of a terrorist threat or assist in an Amber alert. In the top fifty airports alone, over 400 million people emplane annually which does not include the public that drops off or pick up those airline travelers. "President Bush on added some federal muscle to the nation's patchwork of Amber Alert systems, directing the Justice Department to set a national standard for the systems designed to speed information about abducted children to the public."

MSNBC News—Oct. 02, 2002

"The single most important item of unfinished business on Capitol Hill is to create a unified department of homeland security that will vastly improve our ability to protect our coasts and our borders and our communities. The election may be over, but a terrorist threat is still real. The Senate must pass a bill that will strengthen our ability to protect the American people."

President George W. Bush Nov. 7, 2002

Priority one for this nation and is Homeland Security. The President's Budget for 2003—the Federal government's first post-September 11 budget—reflects his absolute commitment to achieving a more secure homeland. The FY 2003 Budget directs $37.7 billion to homeland security, up from $19.5 billion in 2002. This massive infusion of Federal resources reflects the priority the President has attached to the homeland security agenda.

On Nov. 19, 2001, the President signed into law the Aviation and Transportation Security Act, which among other things established a new Transportation Security Administration (TSA) within the Department of Transportation. This Act established a series of challenging but critically important milestones toward achieving a secure air travel system. The President's Budget for 2003 requests $4.8 billion to fulfill the mandates established by the Act.

More broadly however, the Aviation and Transportation Security Act fundamentally changed the way transportation security will be performed and managed in the United States. The continued growth of commercial transportation, tourism and the world economy depends upon effective transportation security measures being efficiently applied. However, the threat to transportation is not restricted solely to those motivated by political or social concerns. In addition to terrorism, TSA will also work to prevent other criminal acts, regardless of motivation.

"If we cannot do a better job of sharing information, we will not be able to effectively identify vulnerabilities, develop needed technology and coordinate efforts to detect and respond to attacks."

United States General Accounting Office Jun. 7, 2002

The Department of Homeland Security would merge under one roof the capability to identify and assess current and future threats to the homeland, map those threats against our current vulnerabilities, inform the President, issue timely warnings, and immediately take or effect appropriate preventive and protective action.

Actionable intelligence is essential for preventing acts of terrorism. The timely and thorough analysis and dissemination of information about terrorists and their activities will improve the government's ability to disrupt and prevent terrorist acts and to provide useful warning to the private sector and our population. Currently, the U.S. government has no institution primarily dedicated to analyzing systematically all information and intelligence on potential terrorist threats within the United States, such as the Central Intelligence Agency performs regarding terrorist threats abroad. The Department of Homeland Security, working together with enhanced capabilities in other agencies such as the Federal Bureau of Investigation would make America safer by pulling together information and intelligence from a variety of sources. The prevention of terrorist acts requires a proactive approach that will enhance the capability of policymakers and law enforcement personnel to preempt terrorist plots and warn appropriate sectors. The Department would fuse and analyze legally accessible information from multiple available sources pertaining to terrorist threats to the homeland to provide early warning of potential attacks. This information includes foreign intelligence, law enforcement information, and publicly available information. The Department would be a full partner and consumer of all intelligence-generating agencies, such as the Central Intelligence Agency, the National Security Agency, and the FBI. By obtaining and analyzing this information, the Department would have the ability to view the dangers facing the homeland comprehensively, ensure that the President is briefed on relevant information, and take necessary protective action.

"Better communications are a fundamental key to better surveillance and to controlling events and disseminating vital information in times of crisis."

SUMMARY OF THE INVENTION

The invention relates generally to anti-terrorist, criminal exposure and law enforcement intelligence sharing and distribution systems. More particularly, a system that allows multiple law enforcement agencies the ability to make instantaneous dissemination of intelligence information to be distributed across the Nation in a variety of high risk homeland locations such as airports, train stations, sports stadiums, etc. and which allows the public the ability to access a terrorist hotline or make an e-911 call with touch of one button. The system allows multiple agencies the ability to add terrorist suspects or other wanted persons into a nationwide intelligence-sharing network. The system incorporates the use of public visual display units that prominently display wanted terrorist information and wanted faces out in the public, thus allowing millions of Americans the ability to stay updated as to whom is being currently sought as wanted suspects in the war on terror. The system uniquely isolates threats to homeland security by monitoring human reaction to constantly changing and updated images and descriptions of wanted terrorist being shown to persons in controlled public settings; i.e. groups in line to enter the country through customs, in line up to pass through airport security check points, or at the airline gate area waiting to board an airplane. Human emotions and reactions to the numerous controlled and changing pictures (stimuli) being introduced into the public at high-risk locations and are monitored by law enforcement personnel via cameras as well as by posted security officers who can, first hand, spot abnormal reactions to the stimuli and act accordingly to secure the area. The system also enables the current homeland security terrorist alert color code and status to be electronically changed and prominently disseminated throughout the country via a nationwide wireless switching system. The system also incorporates the use of a portable e-911 calling wand encased in a destruction resistant housing, that allows either a one button e-911 call or one button direct line terrorist situation report call to be easily made by the general public. The activation of this wand also emits a GPS tracking signal that allows authorities to pinpoint the exact location of the caller thus eliminating possible interference or delay in response to the terrorist alert call. The system also features a back-up portable calling system that allows calls to on-site, security personnel that get monitored as well by federal terrorist monitoring agencies at remote location facilities. The system operates on it's own power supply and is not reliant upon external power in times of power outage. The system utilizes a unique use of the Internet to broadcast nationwide an Internet website that is wirelessly accessed by portable visual display units strategically located in key public places such as customs check in stations and other passenger screening points. Thousands of visual display units are logged on to the Internet and connected to access a master website which sends up-to-date terrorist information nationwide. This systems allows for nationwide dissemination of wanted terrorist or AMBER alert intelligence, without the need to use news stations, or radio, that have large delays in distribution due to other news stories, pre-sold air time, and lack of distribution points in high risk locations across the nation. A master website is updated as needed by law enforcement agencies as new intelligence needs to be distributed. Instantly, new information is transmitted across the nation, or indeed, worldwide, via the worldwide web, to all of the visual display units that are logged on to the Internet with this special predetermined website address. Additionally, each terrorist distribution point can be accessed wirelessly and can transmit real time web cam audio and visual transmissions as needed from thousands of high-risk locations back to on site security as well as a central monitoring station at federal watchdog facilities.

At the airport, via wireless transmissions to portable visual display units strategically located in airports at security checkpoints etc, real-time law enforcement information can be put right in front of the public where is needed the most. Also incorporated into the system is the ability of the information to be converted from a CPU distribution point to a cable head to enable the terrorist and or AMBER alert information to be distributed to select regions via cable stations. Additionally the distribution points are not limited to airport gates and security check points. These units and the system can be set up to be used at airports, hotels, restaurants, sports stadiums, convention centers or virtually any where this vital terrorist and Amber alert information is needed.

While airline hijackings have occurred on several occasions in the past, it was not until the events of Sep. 11, 2001 that the potential use of such aircraft for mass destruction was seen by most people. While boarding checks and other security measures have been in place for many years, the events of September 11 have driven home the point that it is possible for potential terrorists to get past normal security measures and get on board planes or past security check points into public places which could potentially become targets of terrorists. The present invention provides a variety of advantages over earlier systems by incorporating a new combination of technologies to bring about a much more effective system of achieving Homeland Security than has been available to Law enforcement agencies and the nations public.

The present invention is a Homeland Security and Terrorist Awareness System that allows a law enforcement agency to broadly disseminate real-time intelligence to high risk public locations such as airports, train stations, stadiums etc. in order to provide the Nation an immediate update on who to look for. This invention generally relates to increasing homeland security by enabling the general public the ability to easily contact the proper govt. authorities in order to report potential terrorist activities or other threats to homeland peace or well being as well providing government authorities and law enforcement agencies the ability to disseminate homeland security status changes, as well as, quickly spreading visual and audio information regarding wanted terrorists or other wanted suspects, or all points bulletin alerts for missing people, children or the ability to communicate Amber alerts via a high-speed audiovisual electronic communication system.

More specifically this invention provides the general public an easy means of reporting emergencies or suspicious terrorist activity to the proper authorities in public places during normal heights of Homeland security alerts or during times of heightened security alert, emergency power shortage or outage, times of enforced confinement, manmade or natural disasters or any other threats to civil or government well-being as well as providing wide spread tracking points for e-911 emergency calls placed from the device.

Terrorism Response and Alert Program (TRAP)

This invention was designed in response to the continued threat of terrorist threats to the United States of America. Its purpose is an alert system to keep the public and officials in our nations transportation centers, aware of any new and urgent terrorist threats and an immediate reporting system.

This system, called TRAP (Terrorism Response and Alert Program), would be placed in the nations transportation centers—airports, train, bus, and subway stations—to keep the public informed of any new threats, and to constantly update the terrorists that are currently wanted. This system is self-contained and completely wireless, and intended to be distributed in areas of heaviest traffic flow in the mentioned transportation centers. TRAP contains amongst other features the following security assets:

- Terrorist Display Monitor (TDM) displaying pictures of currently wanted terrorists or amber alert suspects. Pictures would change at preset times.
- Immediate Alert System (IAS) displays scrolling text messages regarding any current threat alerts or information for immediate release
- Camera that will record any specific reaction responses (SRR) or unusual behavior.
- These cameras to be monitored in the security offices of any specific location.
- Current threat level based on the Homeland Security Advisory System updated wirelessly.
- Cellular Phone directly connected to onsite security office or FBI to report any suspicious activity or suspected terrorist.

Through wireless technology and on-board CPU, updates can be disseminated almost immediately to any of the TRAP systems in place, keeping the general public and officials at these transportation centers informed of any new developments. These updates can be wirelessly transmitted by the agency involved or from the security personnel on site.

DRAWINGS

Figure 2:
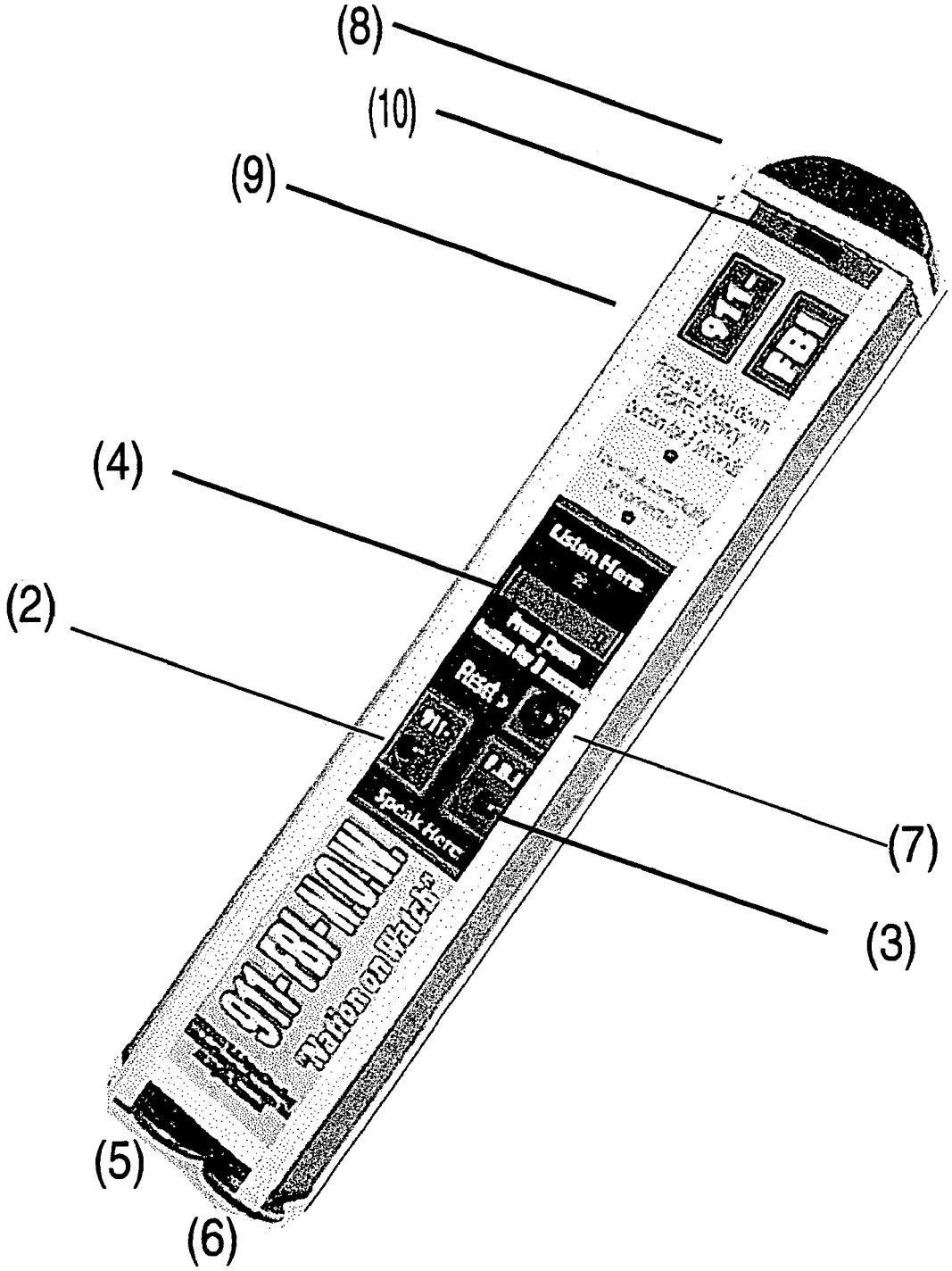
Figure 3:
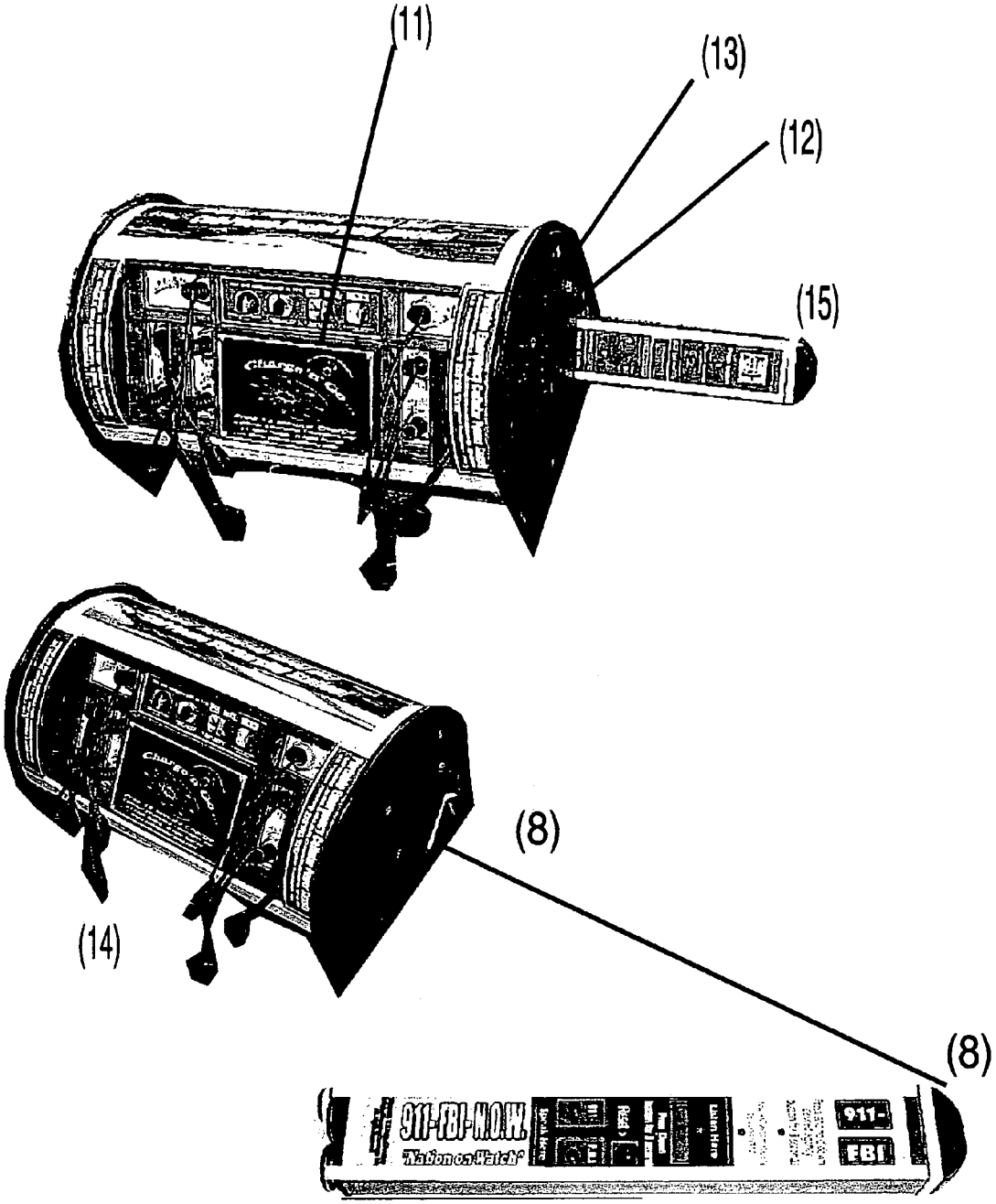
Figure 4:
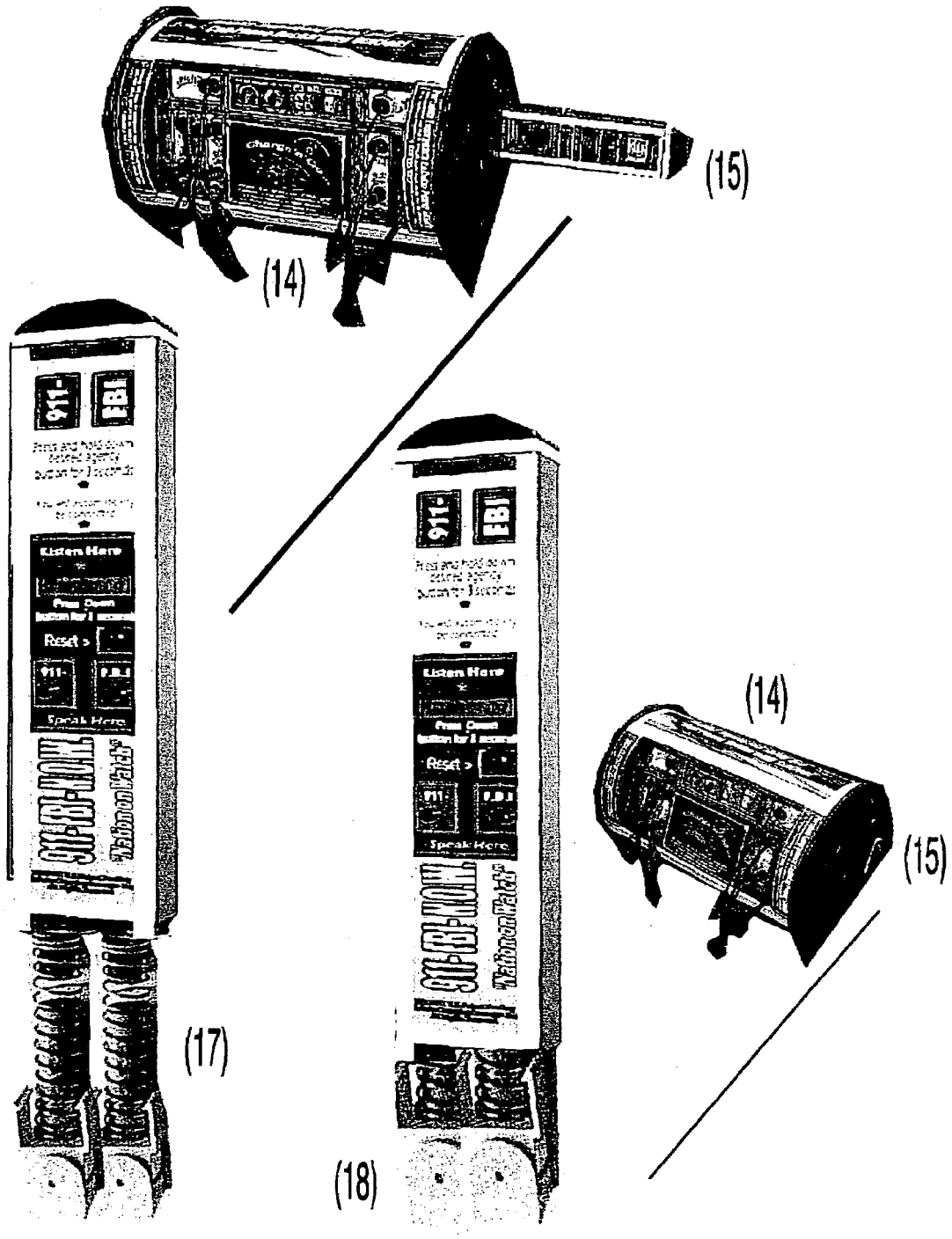
Figure 5:
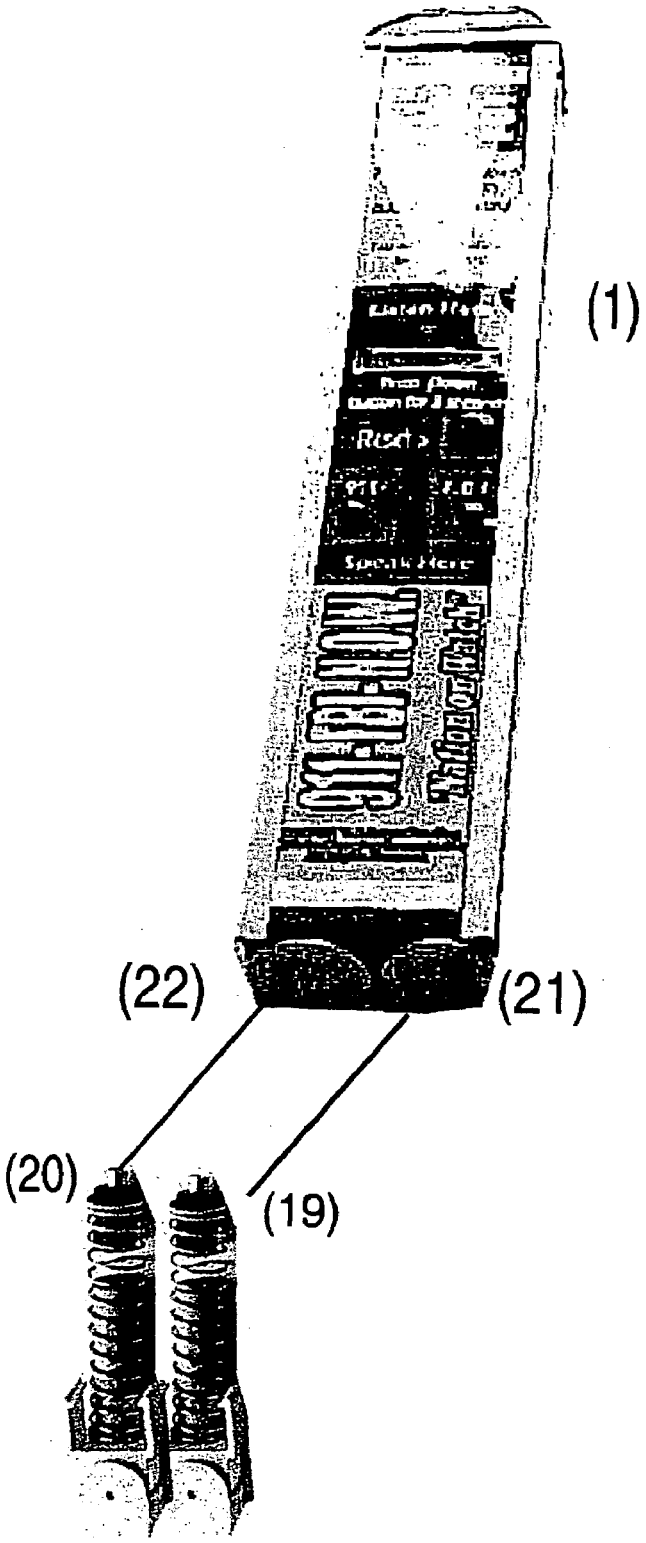
Figure 6:
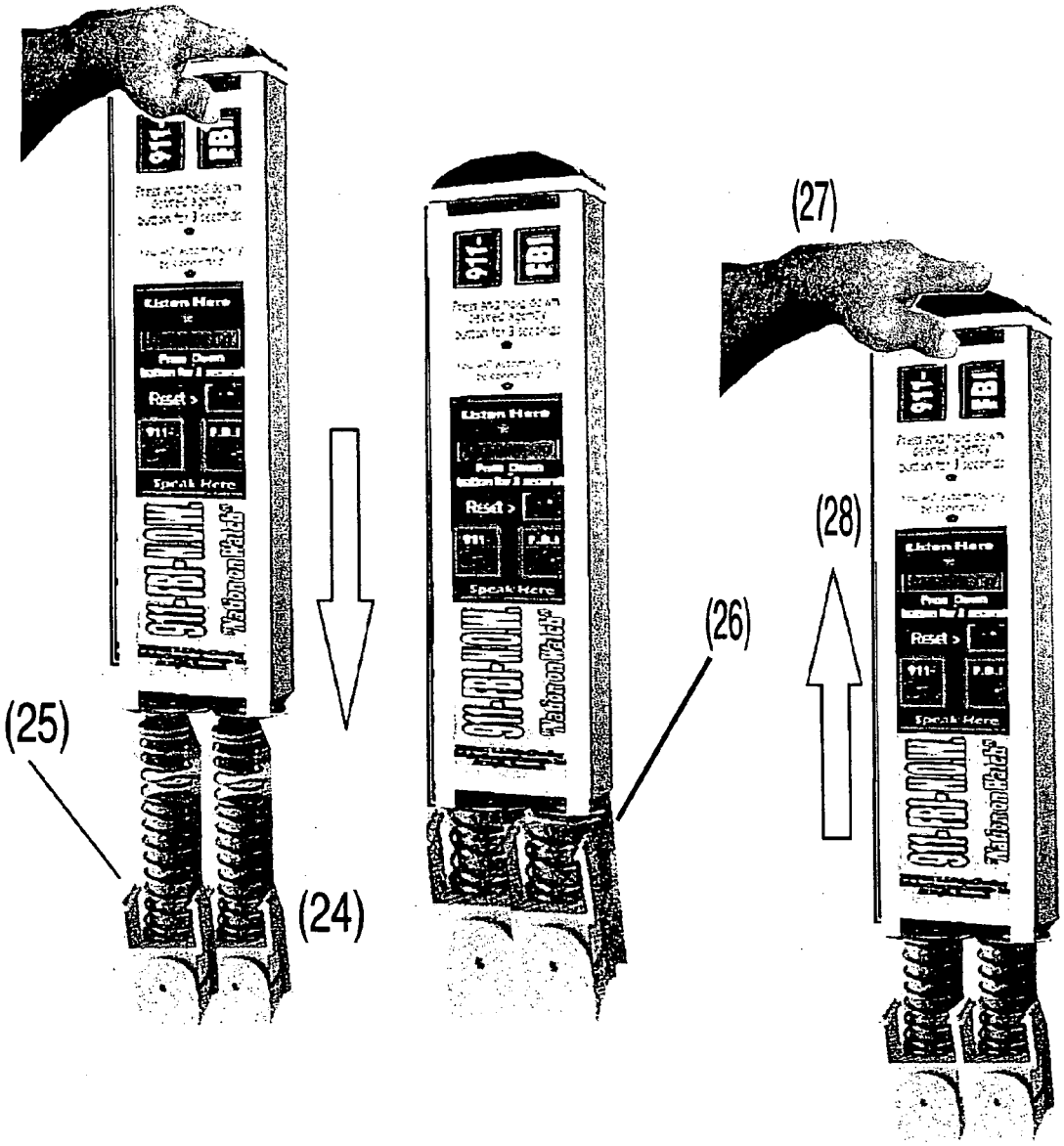
Figure 7:
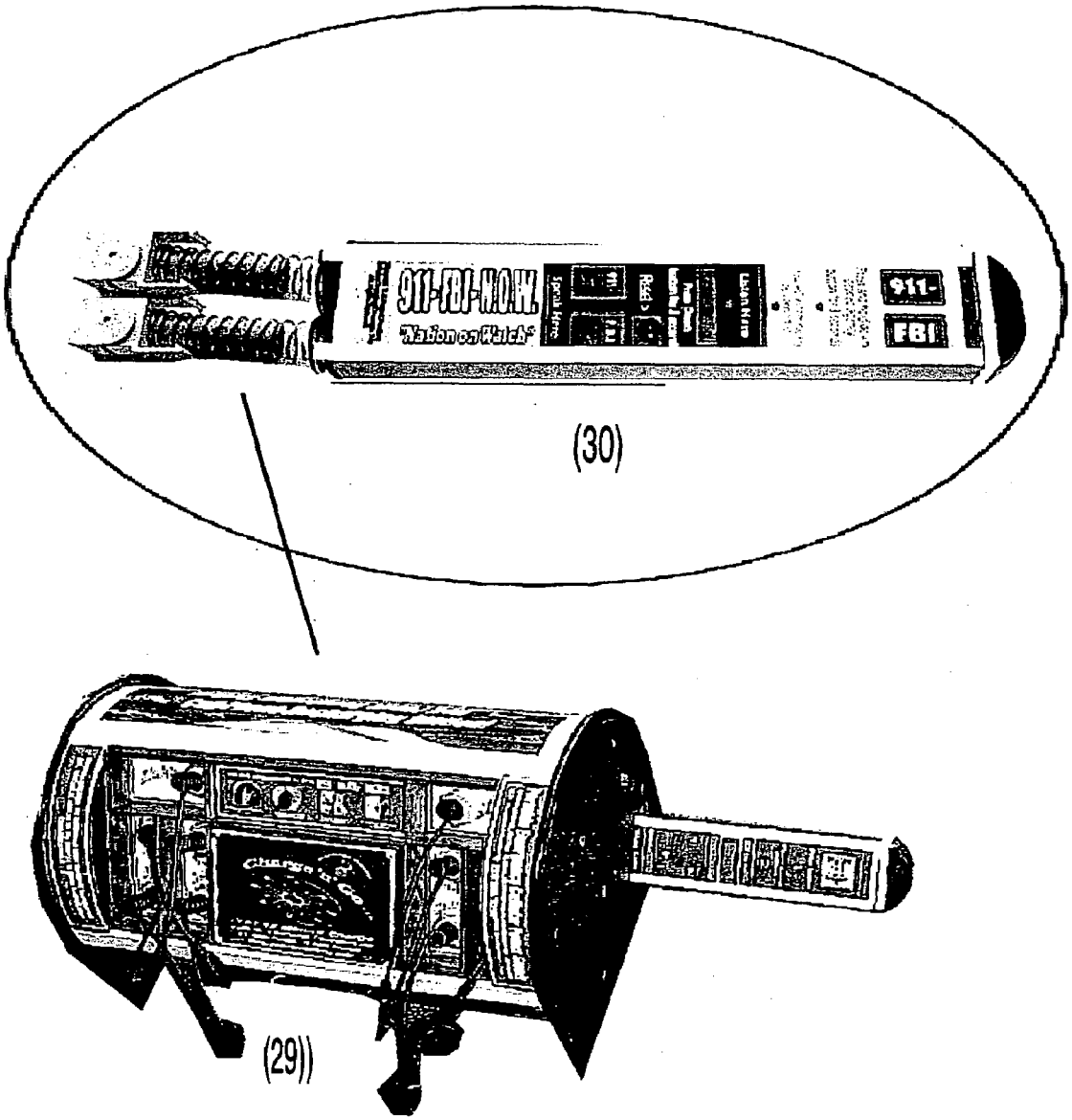
Figure 8:
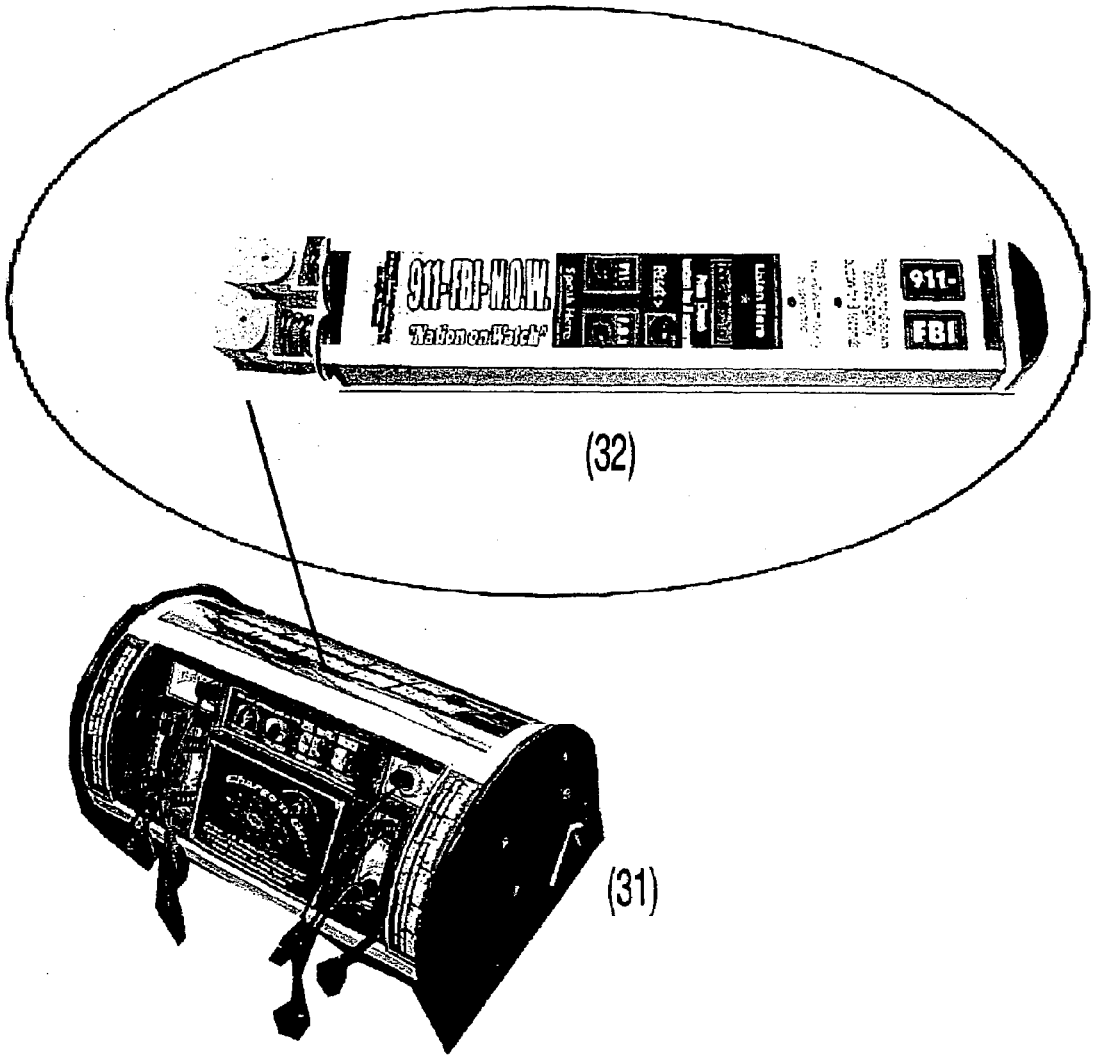
Figure 9:
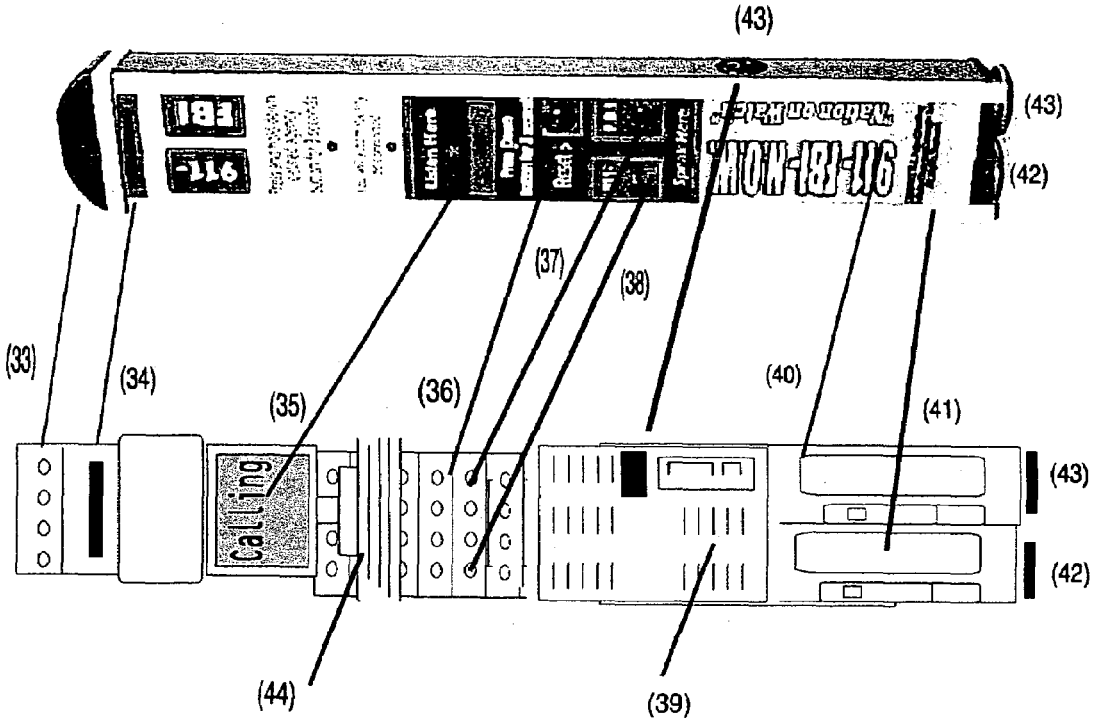
Figure 10:
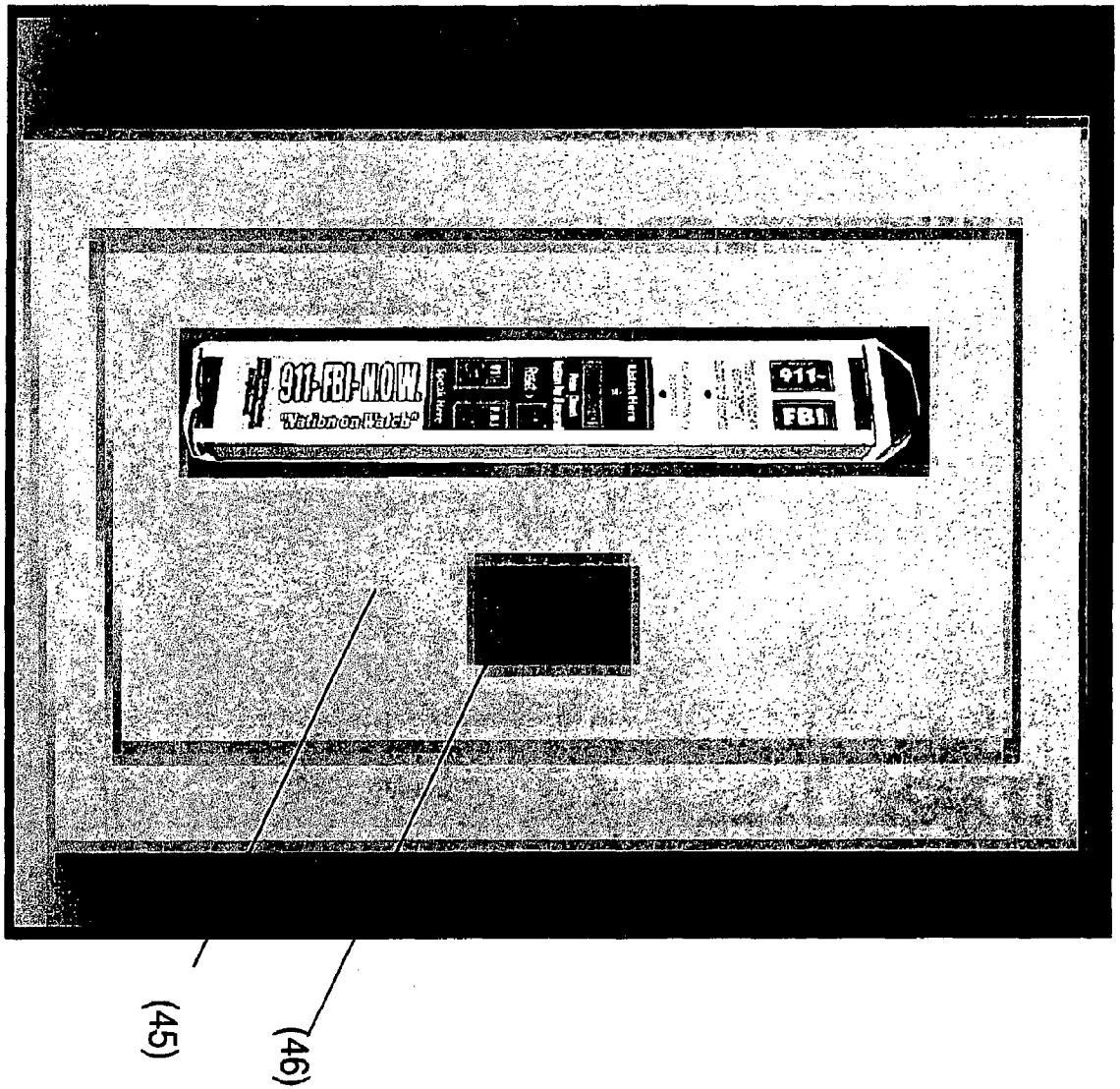
Figure 11:
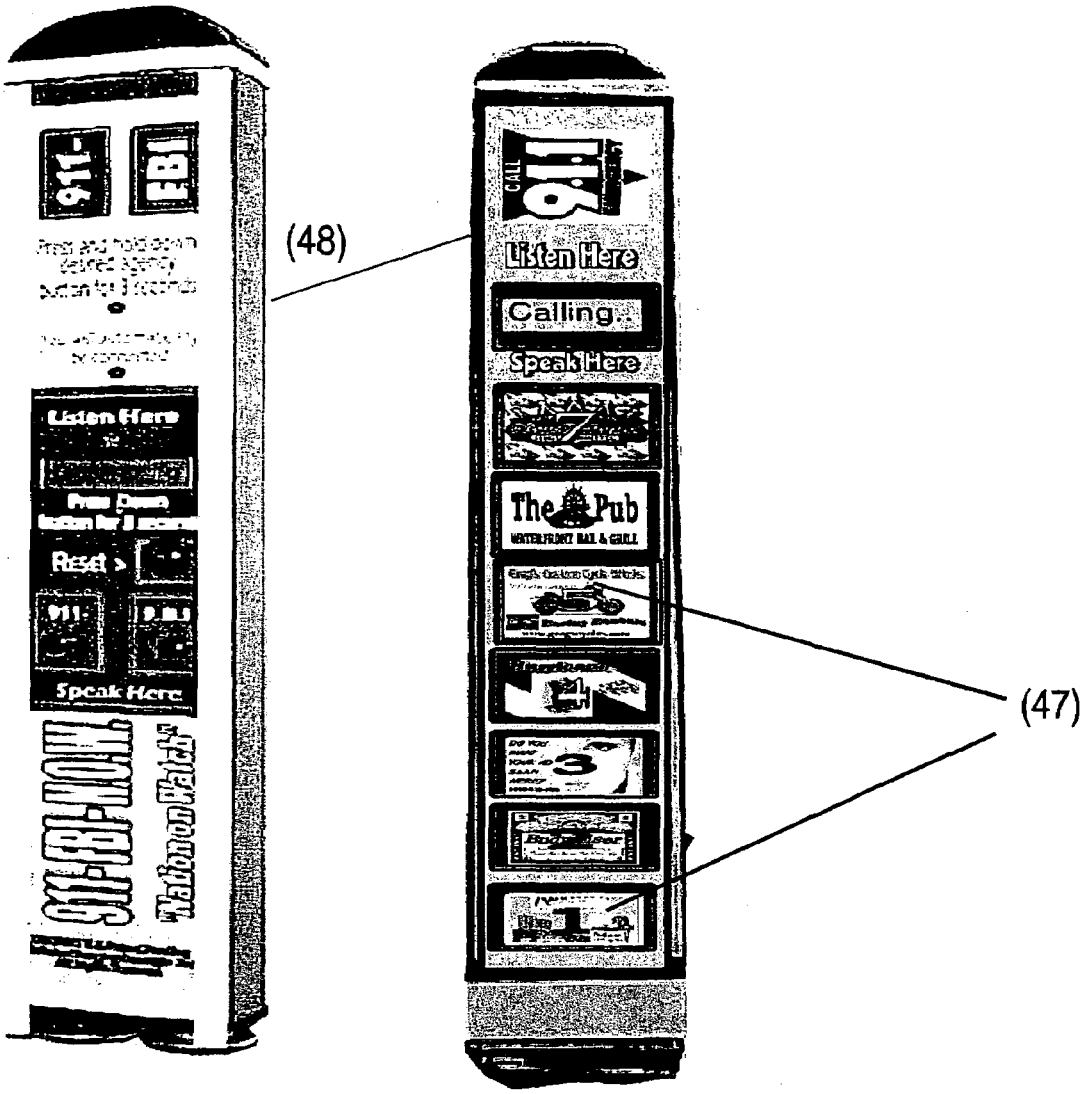
Figure 12:
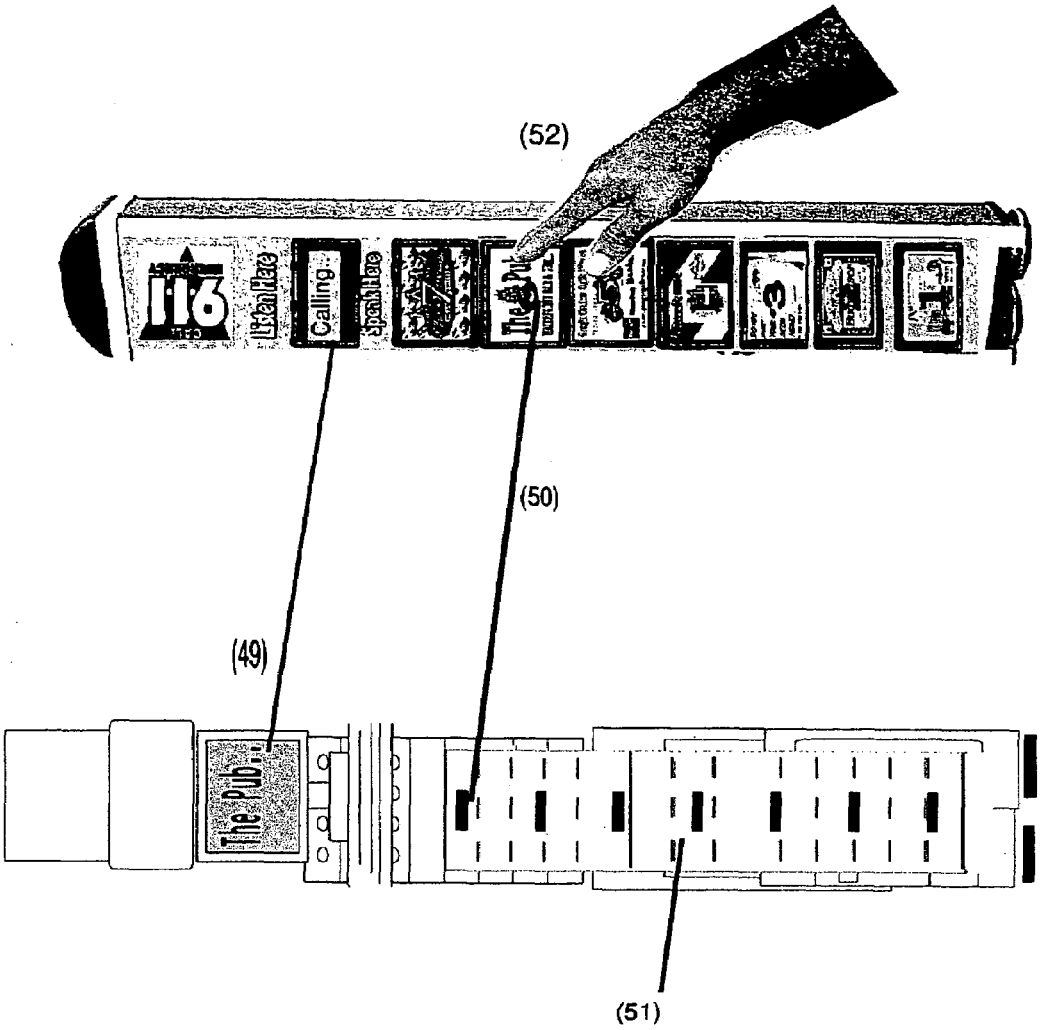
Figure 13:
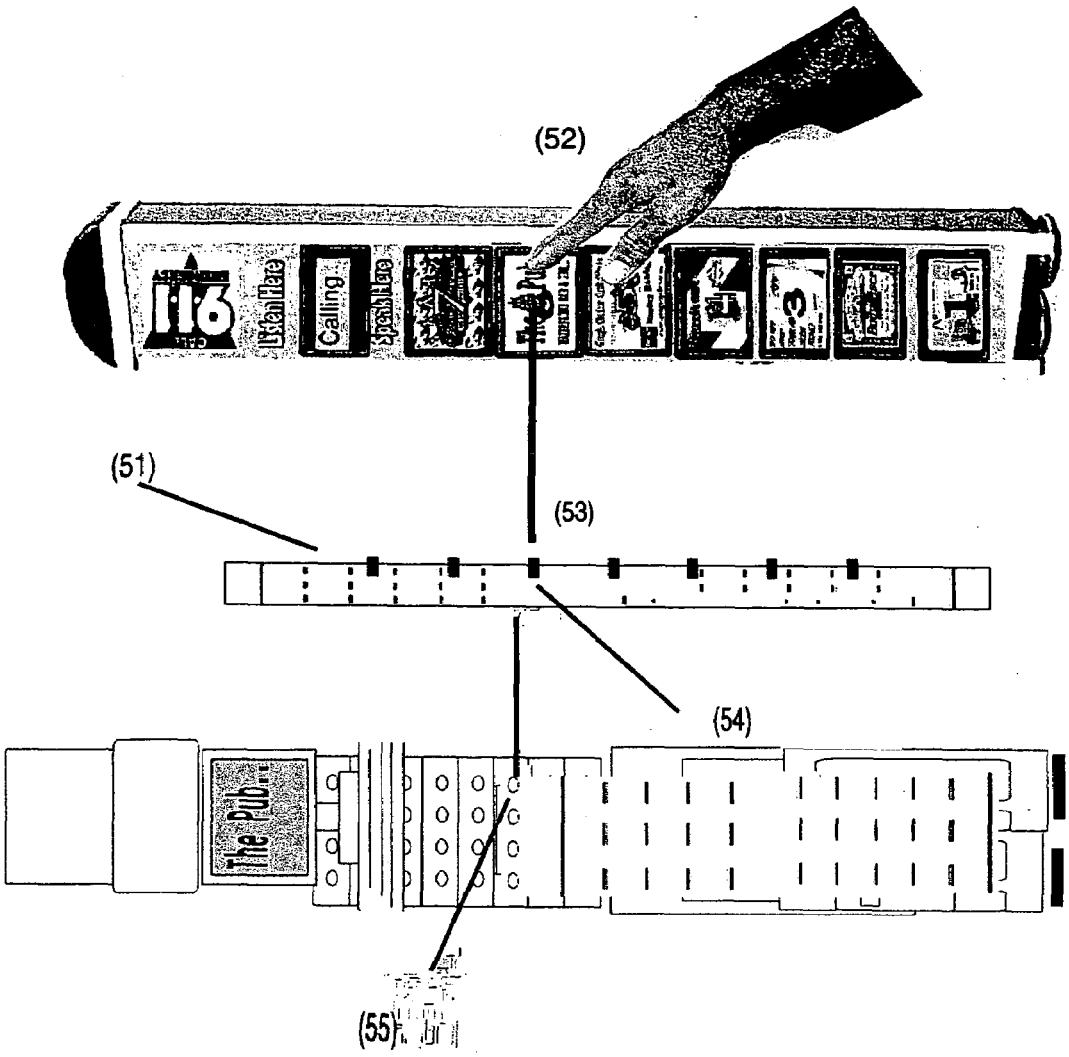
Figure 14:
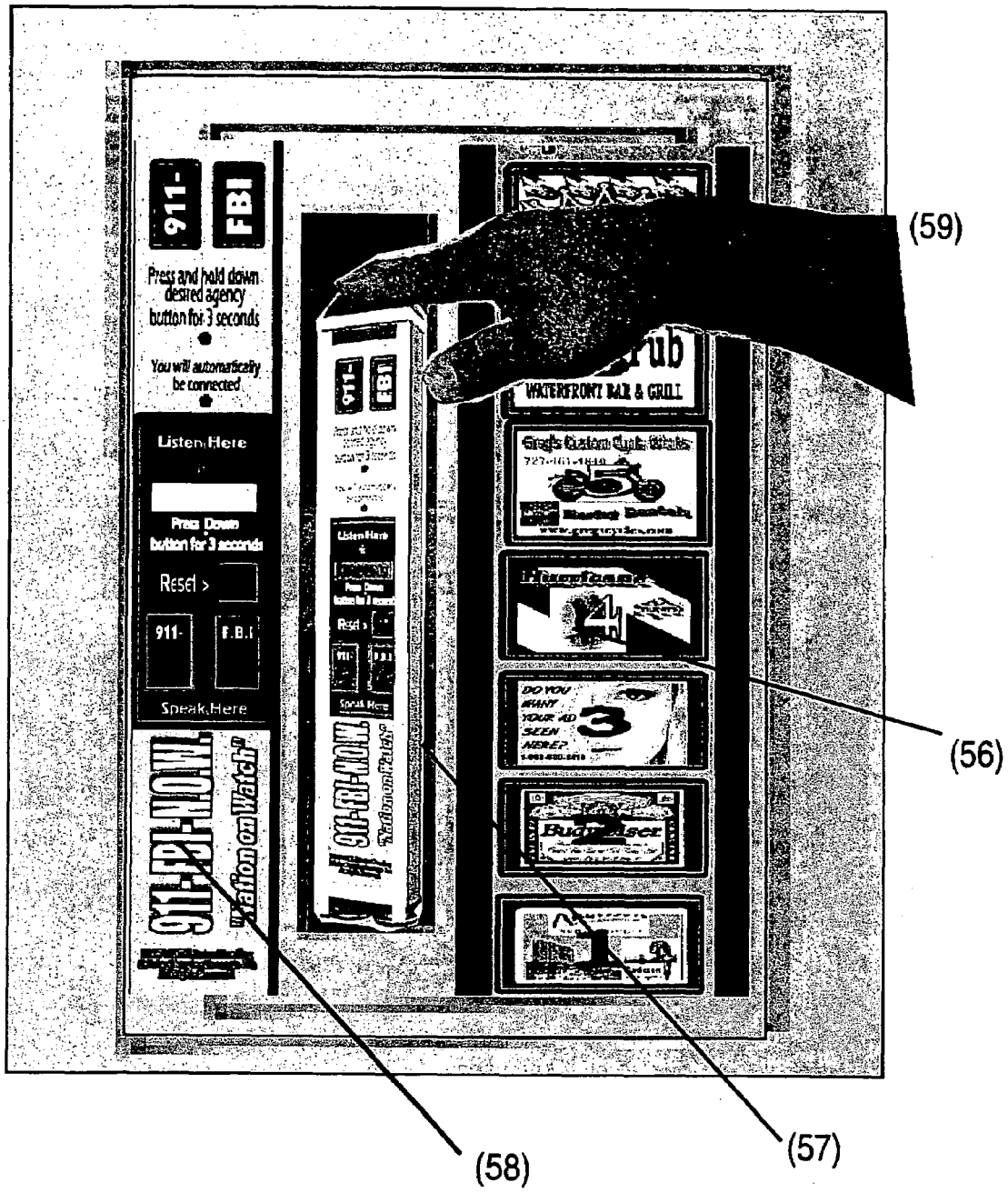
Figure 15:
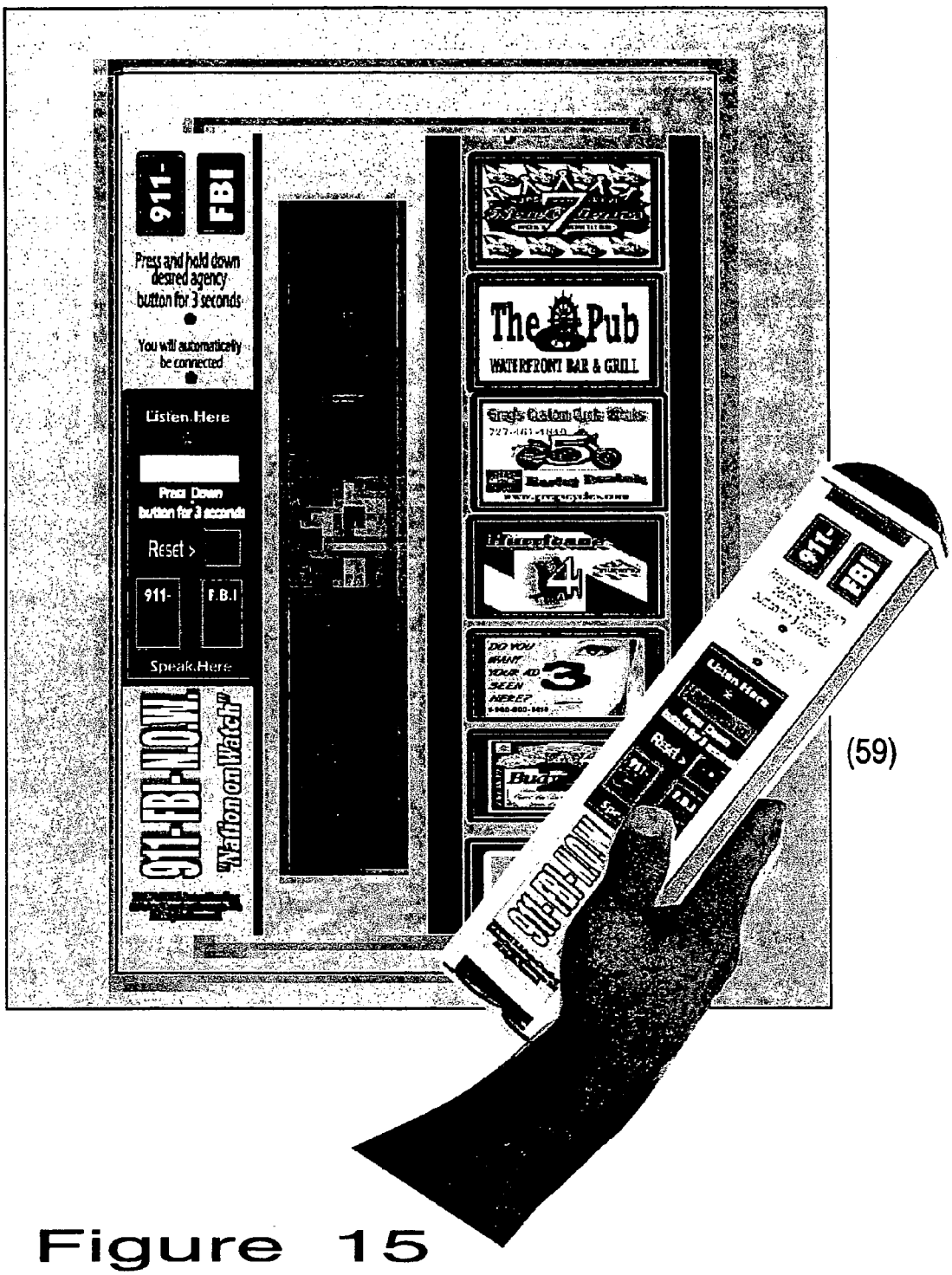
Figure 16:
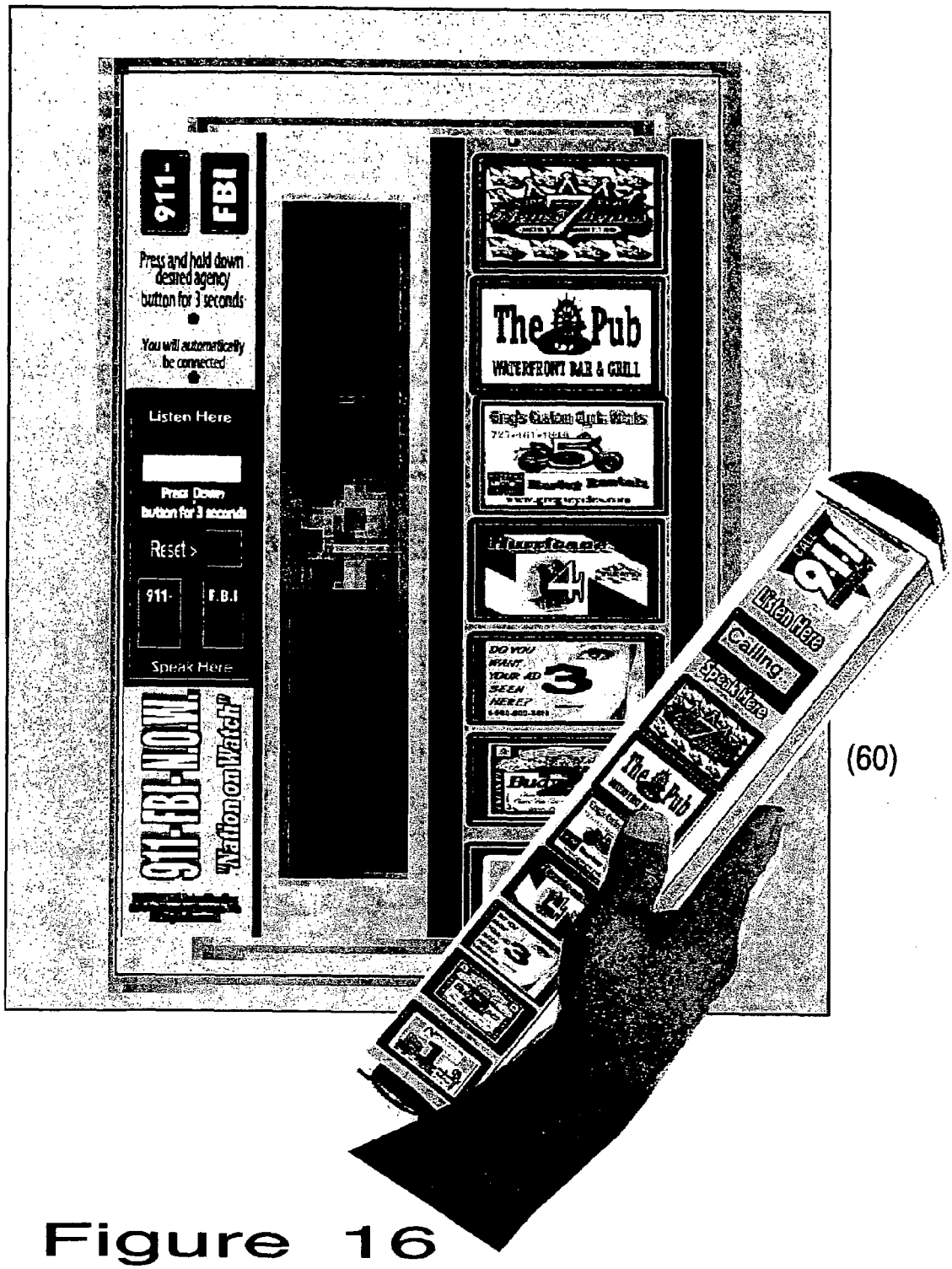
Figure 17:
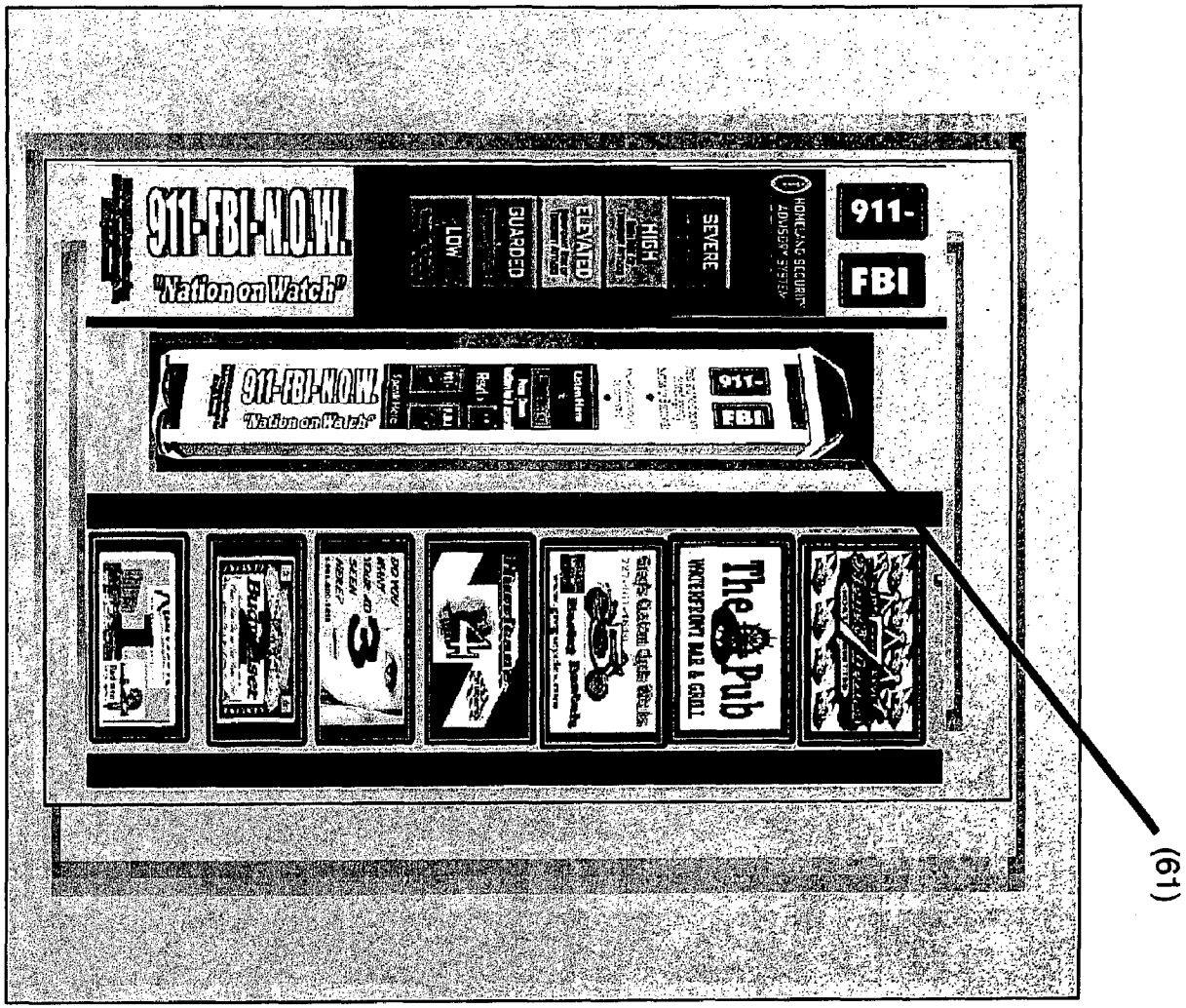
Figure 19:
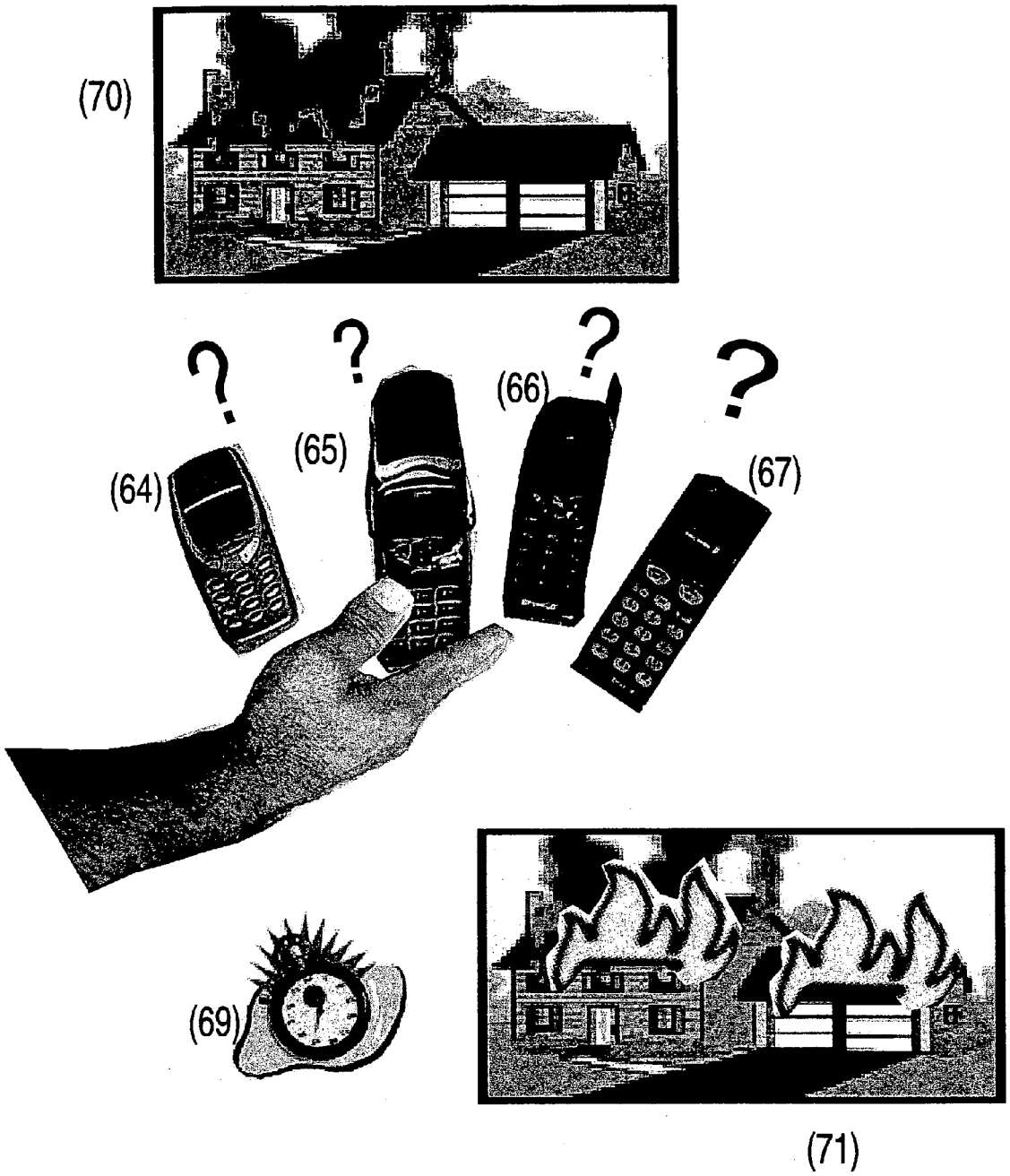
Figure 20:
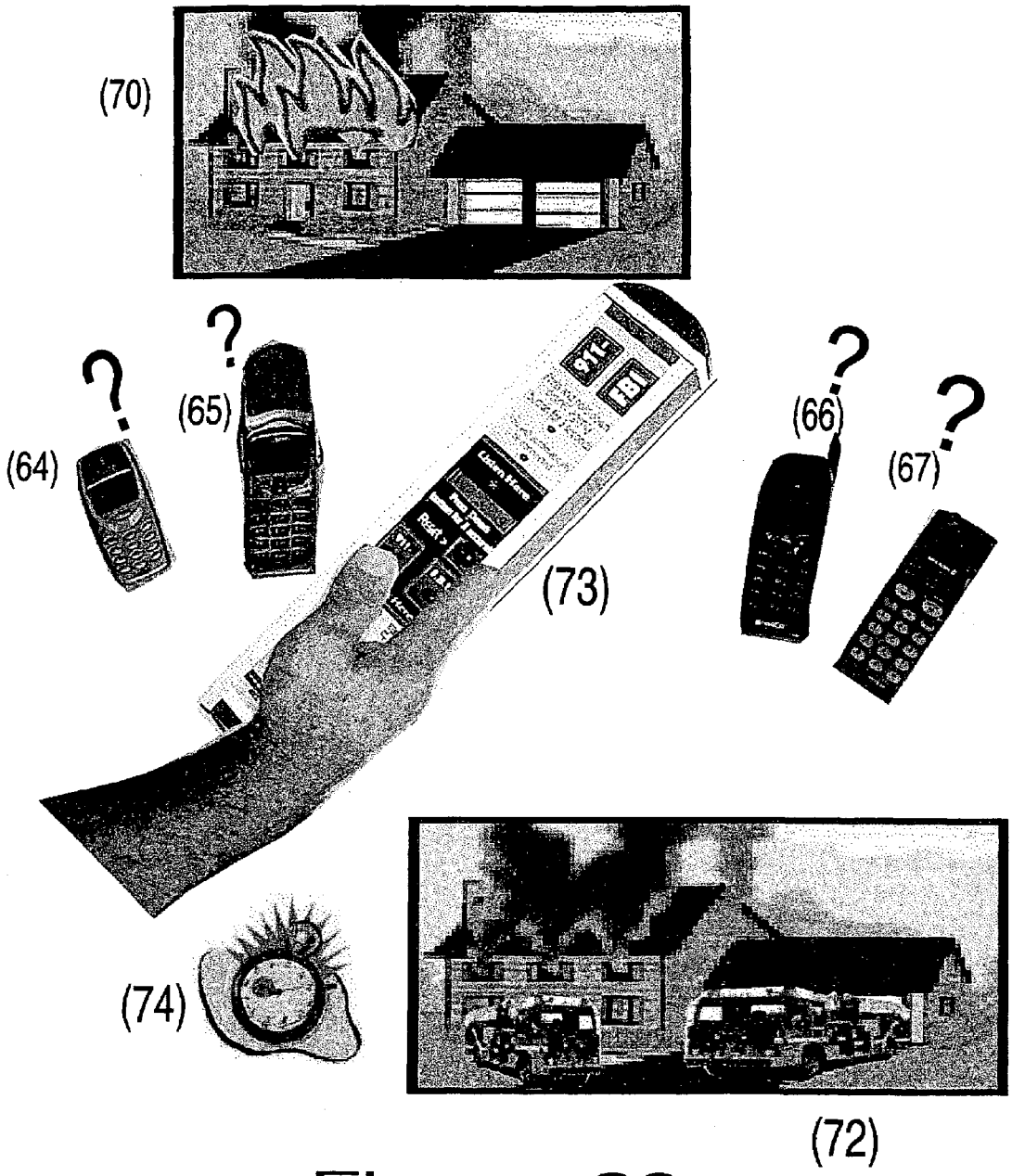
Figure 21:
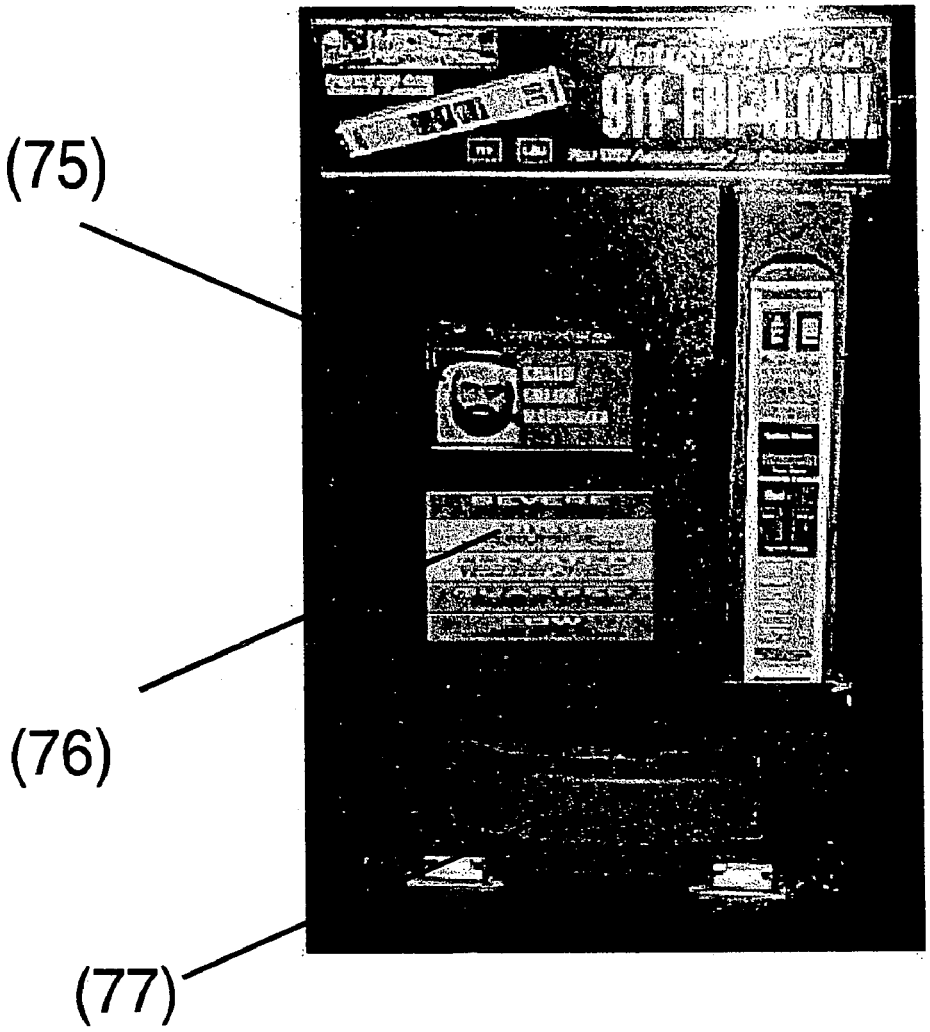
Figure 22:
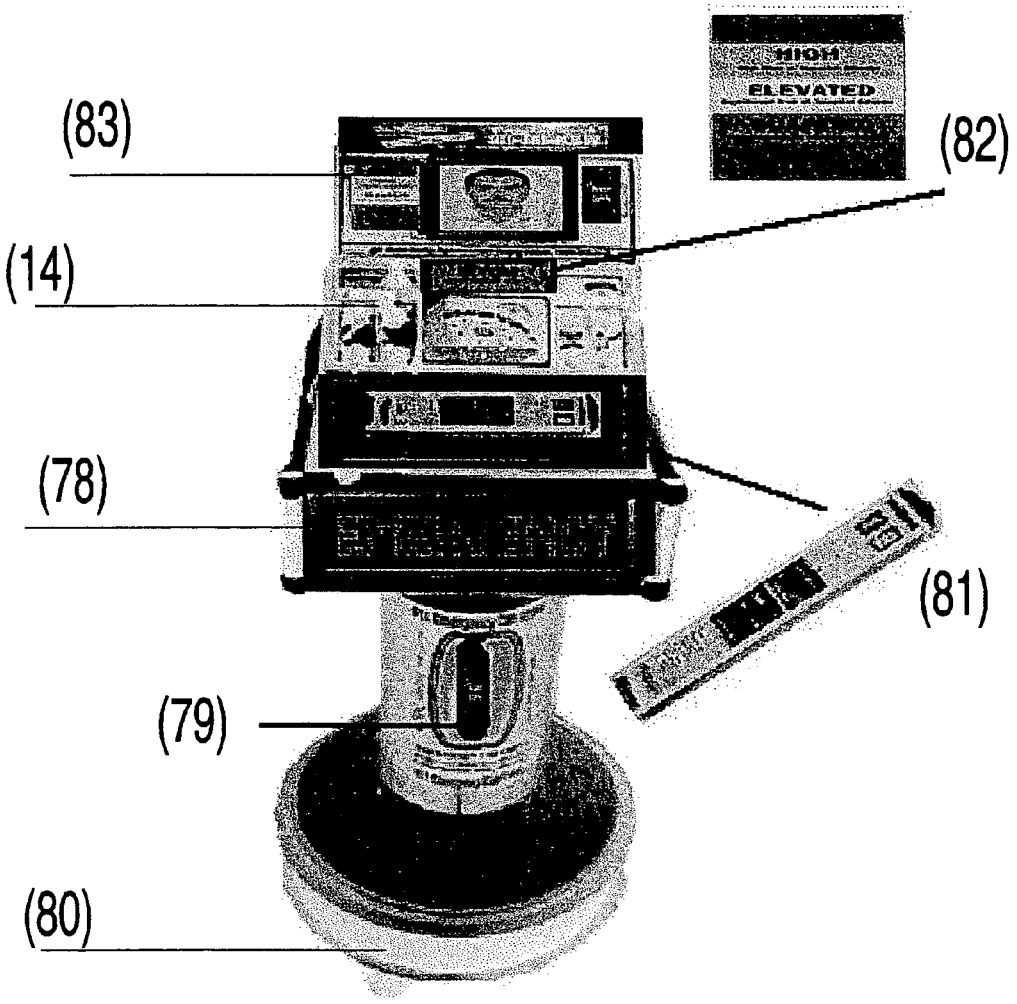
Figure 23:
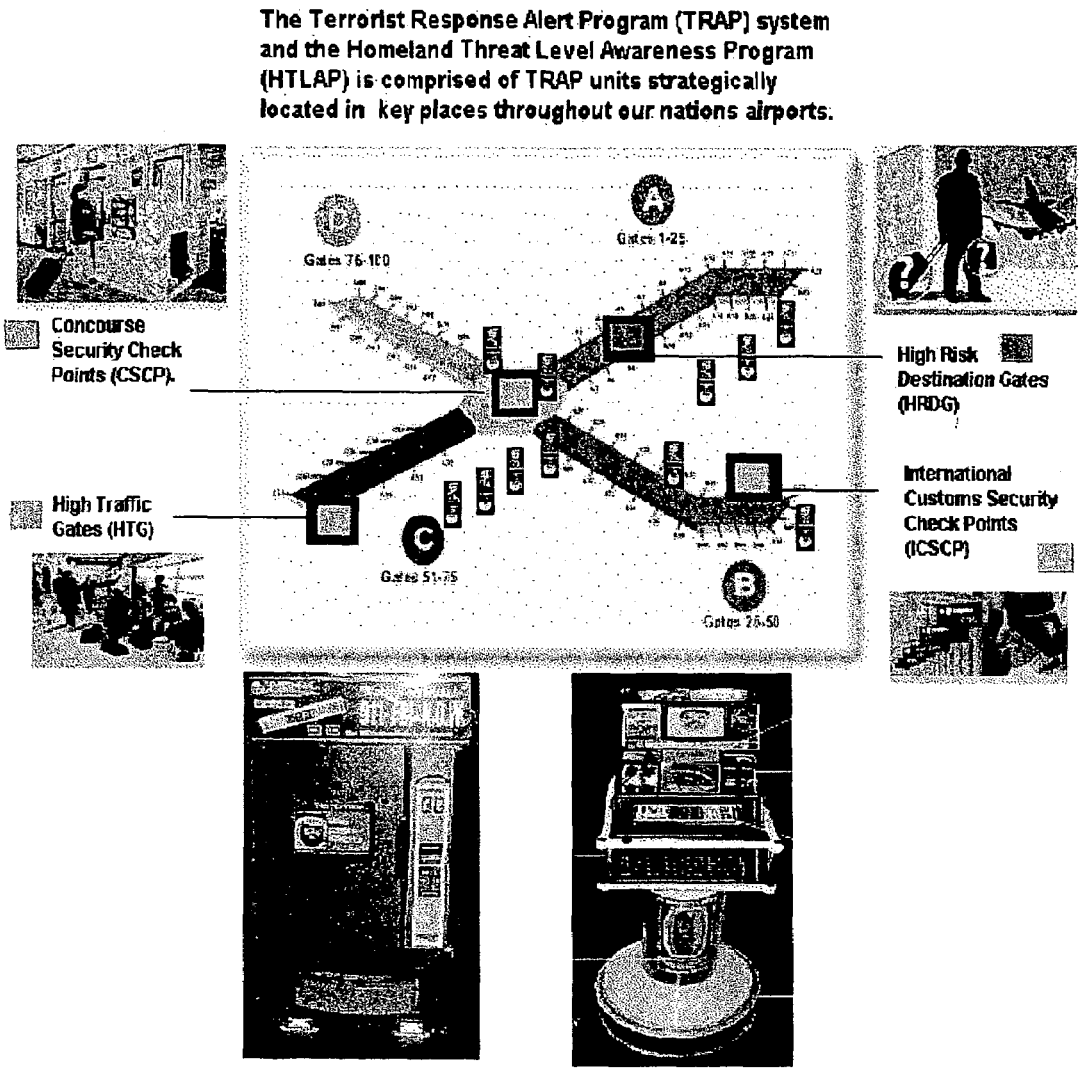
Figure 24:
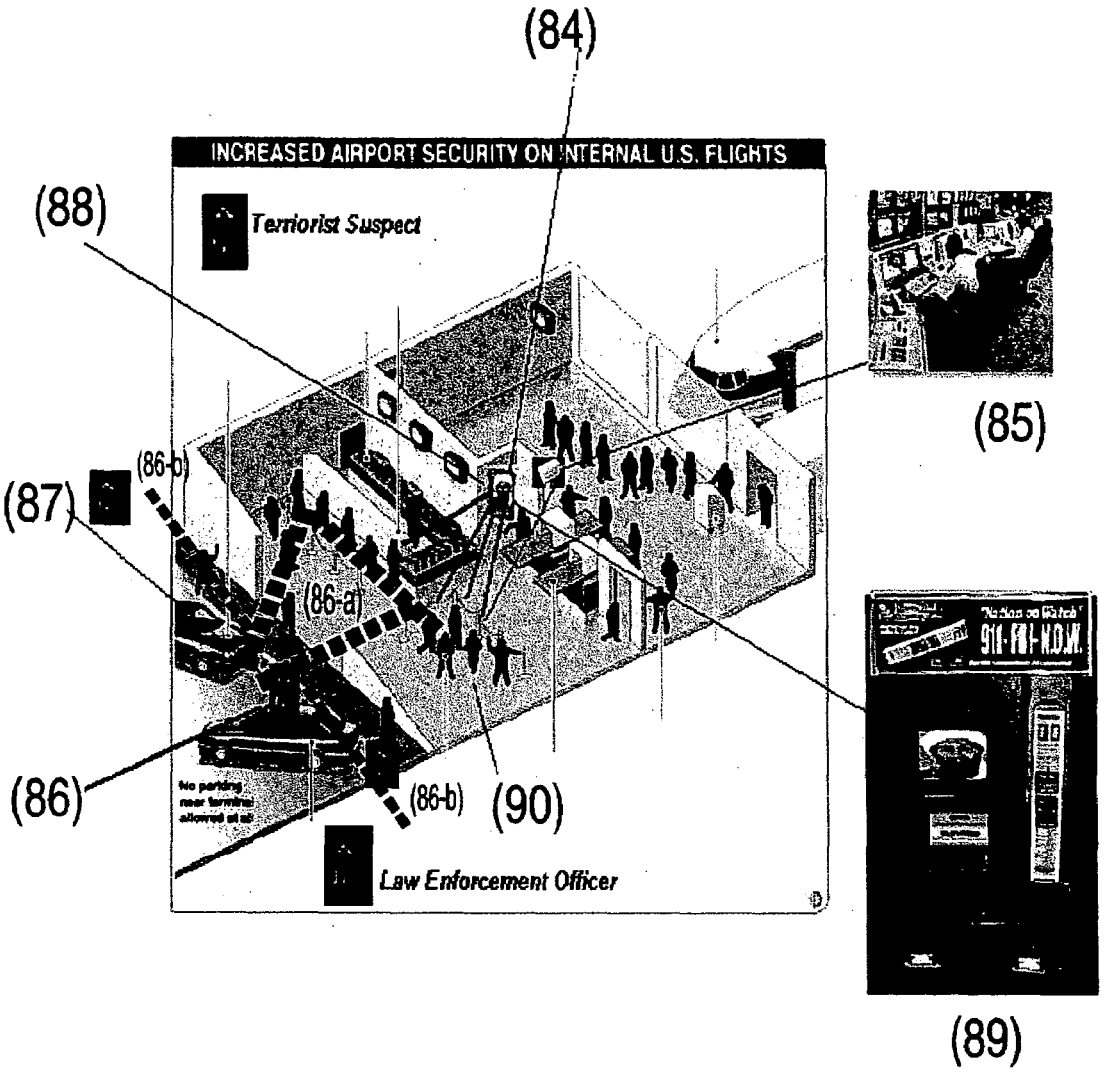

FIG. 1
e-911 terrorist hotline wand
FIG. 2
(2) e-911 hotline button
(3) terrorist hotline button
(4) LED/LCD readout
(5) negative connection point
(6) positive connection point
(7) reset button
(8) Beacon
(9) Switch
(10) Housing
FIG. 3
(11) Start switch
(12) recharging port
(13) charging indicator light
(14) portable emergency cellular charger
(15) e-911 wand sliding out of housing
FIG. 4
(17) spring loaded electrical contact points
(18) spring loaded charging block structure
FIG. 5
(19) positive connection transfer point
(20) negative connection transfer point
(21) positive connection receipt point
(22) negative connection receipt point
FIG. 6
(24) shows hand pressure pushing the wand down to catch points
(25) shows the springs extended and being depressed
(26) shows the springs fully depressed and holding the wand down
(27) shows the momentary pressure down to release the wand
(28) shows the spring pressure pushing up to release the wand for use
FIG. 7
(29) shows the e-911 wand coming out of the unit
(30) shows an internal illustration of wand action
FIG. 8
(31) shows the wand fully inserted
(32) shows an internal illustration of wand depressed inside
FIG. 9
(33) beacons lights
(34) internal switch
(35) LCD panel
(36) touch pad
(37)—e-911 auto programmed touch pad
(38) terrorist hotline auto programmed touch pad
(39) cellular transmitter
(40) back up battery 1
(41) back up battery 2
(42) negative contact bar
(43) positive contact bar
FIG. 10
(45) e-911 wand in wall mounted enclosure
(46) wall mounted door latch
FIG. 11
(47) auto dial sponsor buttons
(48) back side of e-911 wand
FIG. 12
(49) sponsor LCD readout
(50) internal action to auto dial sponsor against touch pad
(51) touch pad for multiple sponsors
(52) customer action to call sponsor external view
FIG. 13
(54) customer action to call sponsor closing switch to auto dial circuit (55)
(55) auto dial circuit
FIG. 14
(56) sponsor advertisement
(57) e-911 wand with sponsor autodial
(58) e-911 instructions
(59) customer removing the e-911 wand
FIG. 15
(59) customer removing the e-911 wand
FIG. 16
(60) reverse side of the e-911 wand with ad touch pad
FIG. 17
(61) beacon light displaying the current homeland security alert status color code
FIG. 18
(62) action of calling for help by pressing one button calling wand
(63) shows help arriving
FIG. 19
(64) (65) (66) (67) various model, cell phones
(69) shows time wasted trying to figure out how to operate the phones
(70) shows a house on fire
(71) shows fire spreading due to too much time
FIG. 20
(72) shows the help arriving on time due to the one button e-911 call
(73) shows the e-911 call being made without confusion
(74) shows fast response and no wasted time in calling for help
FIG. 21
(75) shows electronic wanted poster displaying terrorist images
(76) displays the current homeland security terrorist alert status
(77) shows the built-in terrorist hotline for backup emergency calling
FIG. 22
(78) shows a wireless LED display for showing vital information
(79) shows a wireless back reporting phone and terrorist hotline
(80) shows the base and power supply housing
(81) shows the e-911 wand
(82) the homeland security status alert signage
(83) LCD screen for displaying waned terrorist and amber alert information
(14) is the emergency cellular charging unit
FIG. 23—shows the applications for the terrorist reporting and alert units at an airport
FIG. 24—shows the system in an airport
(84) shows real time transmission of wanted terrorists being displayed in an airport
(85) shows behind the scenes security monitoring of suspicious reactions to the pictures being displayed
(86) shows a terrorist suspect having left the airport after seeing the visual display showing wanted terrorist
(87) shows a law enforcement officer zeroing in on a fleeing terrorist
(88) shows the changes in pictures being shown to the public
(89) shows the terrorist awareness unit in detail
(90) shows the public now being more aware of wanted people to look for

FIG. 25

Figure 27:
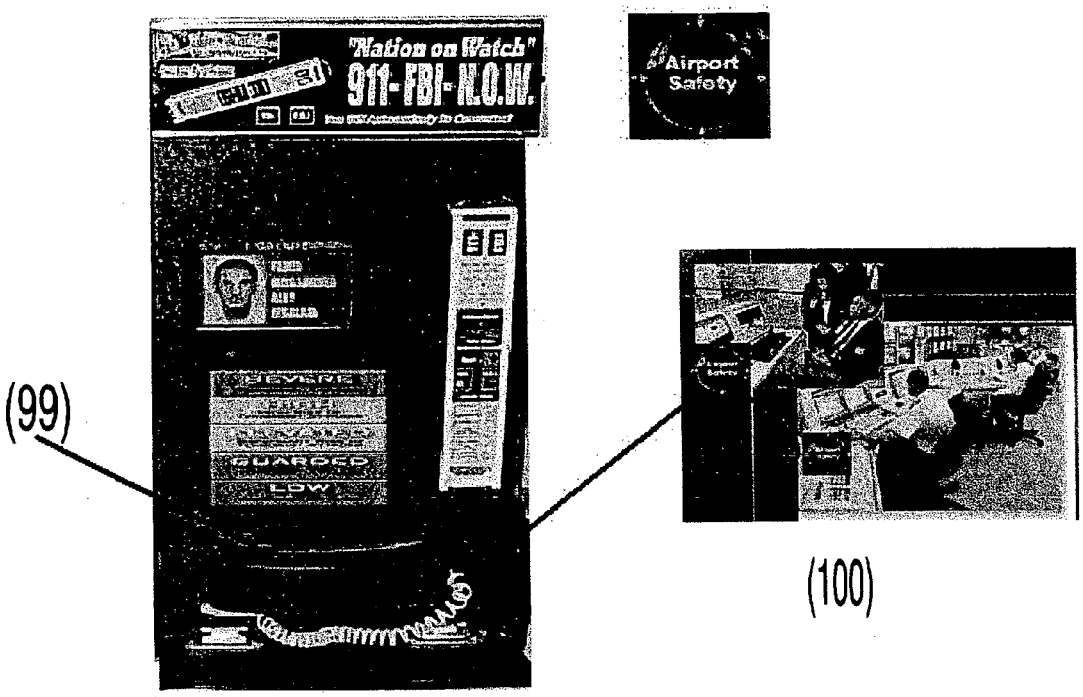
Figure 28:
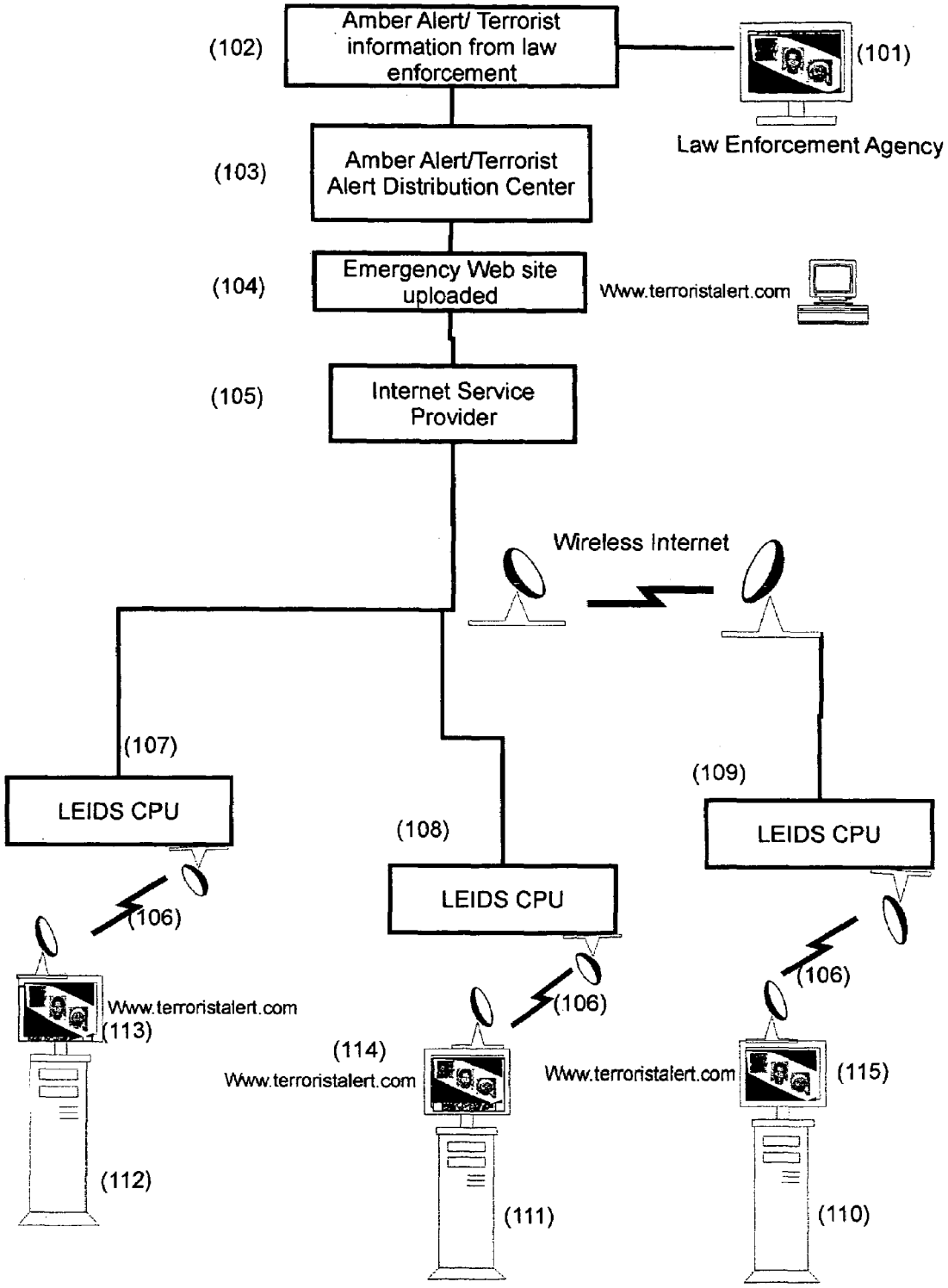
Figure 29:
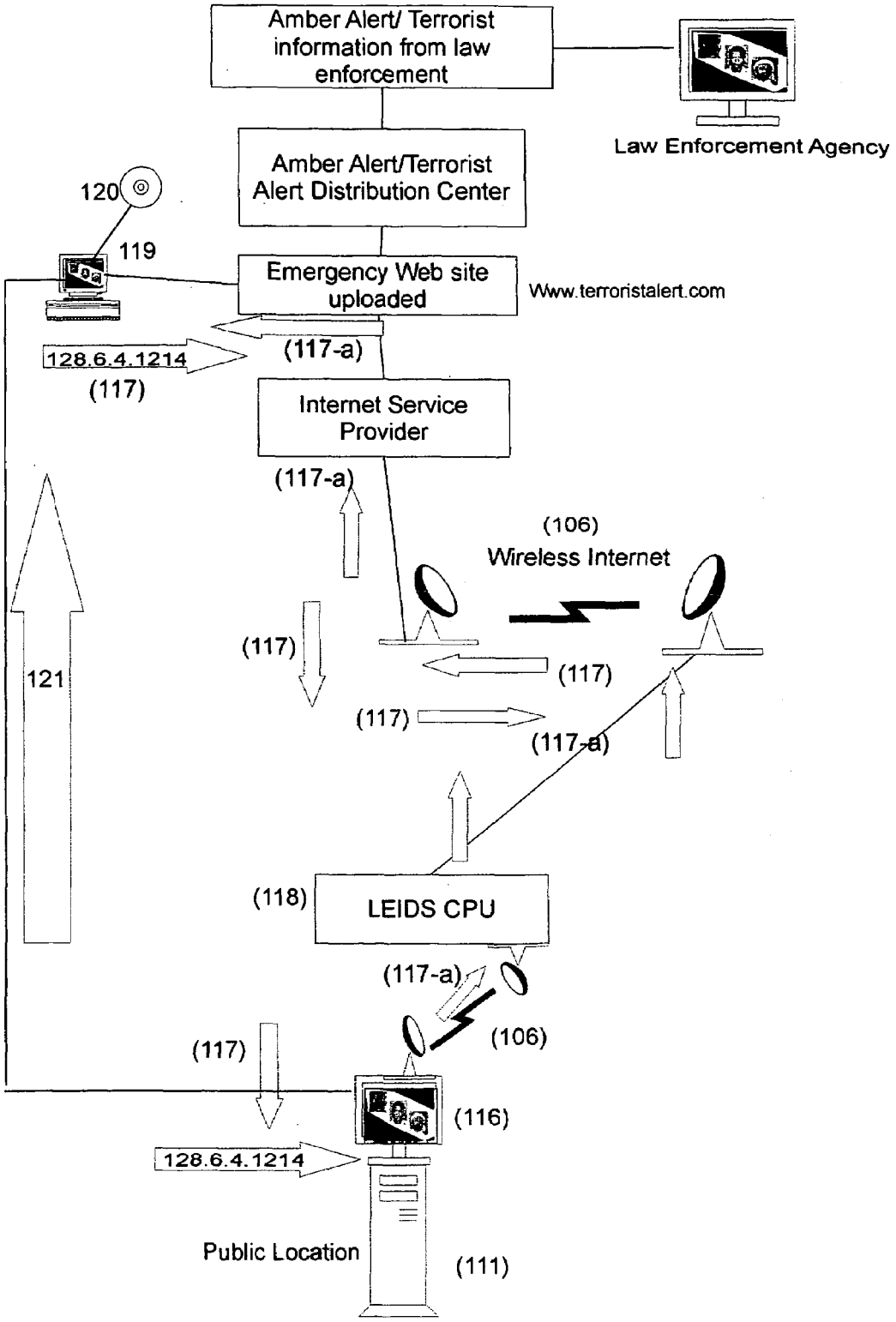
Figure 30:
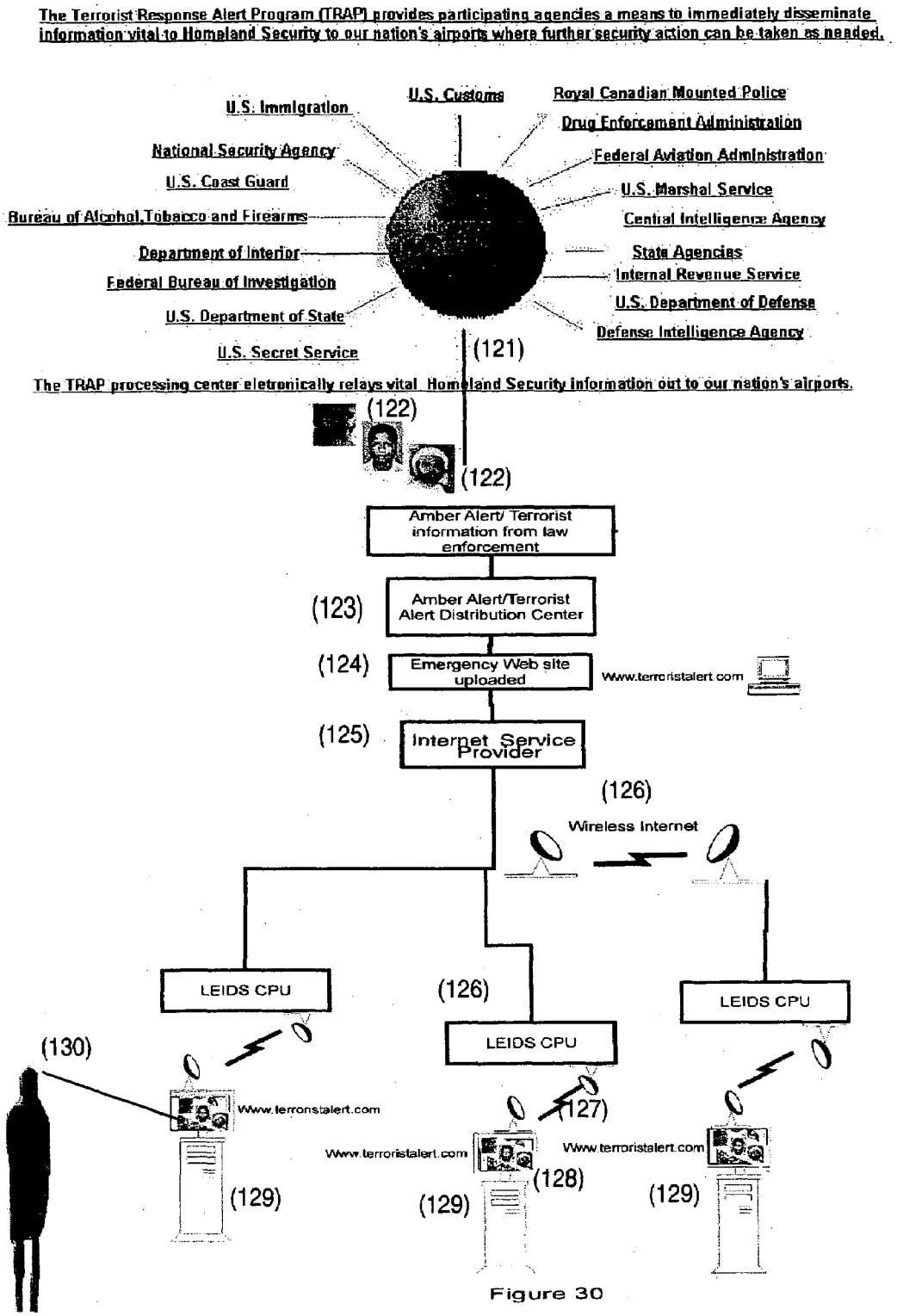
Figure 31:
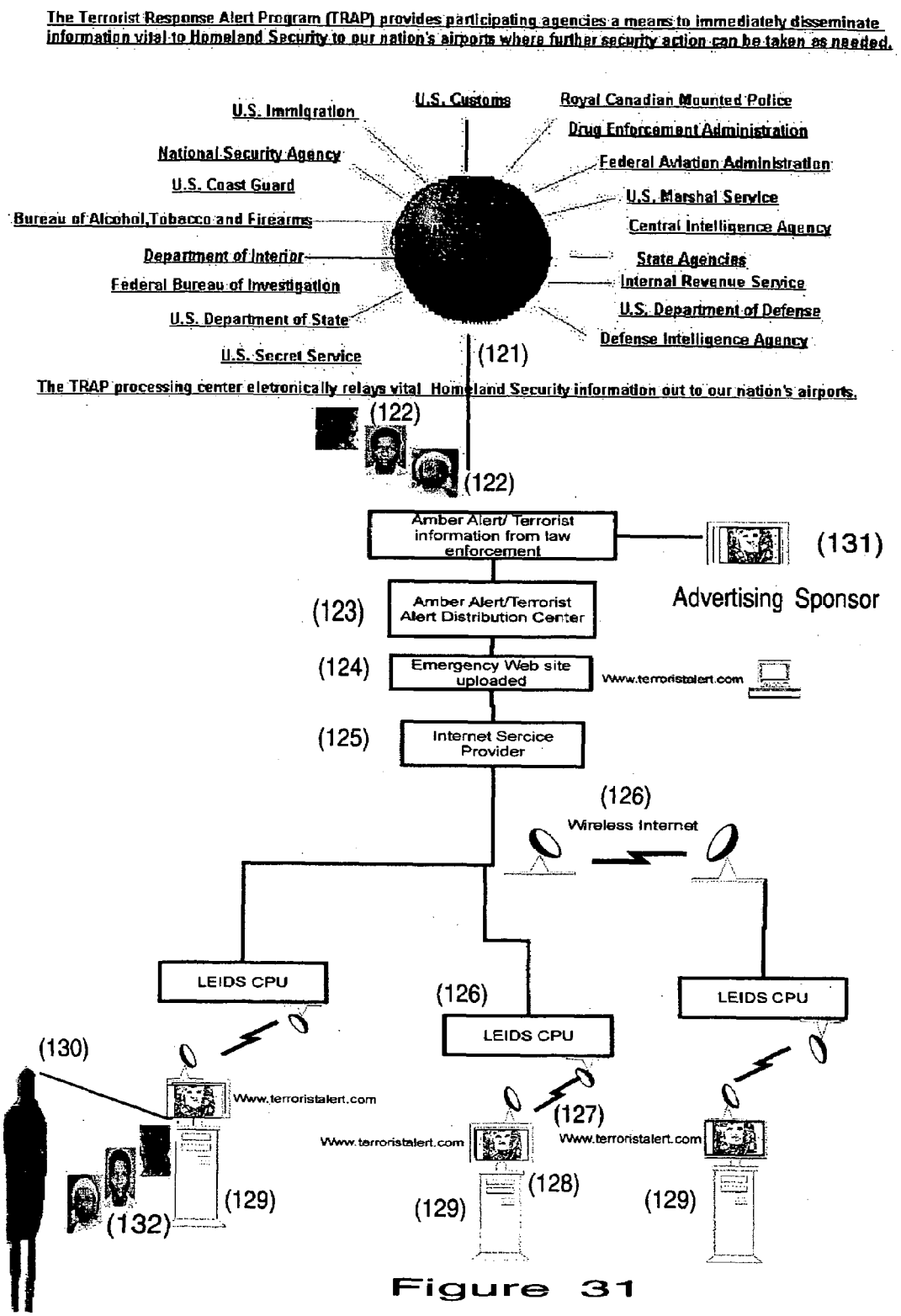

(91) shows a terrorist suspect noticing the wanted terrorist pictures (92) shows the suspect in the suspicious reaction zone (93), and (94) shows the suspect leaving the area so as not to be detected (95) shows the suspect leaving the area so as not to be detected and being detained by security (96) shows the suspect being watched and identified by security (97) who calls officers to detain the suspect (98) shows federal watchdog authorities also monitoring the situation FIG. 26—Shows the intelligence coordination between various agencies in order to make wanted terrorist information available at key security points across the nation FIG. 27—Shows the blue line security terrorist hotline for reporting suspicious activity (99) shows the blue line phone (100) shows the receipt points of the terrorist hotline at a federal watchdog point as well as local security personnel

FIG. 28

(101) shows law enforcement intelligence information being sent to an Intelligence clearance source (102)

(103) intelligence is received by a terrorist/amber alert distribution center (104) an emergency website is updated for worldwide web distribution (105) Internet service provider sends out data to the Internet (106) shows the wireless Internet distribution of the information (107), (108), (109) are CPU'S with wireless Internet transmission capabilities (110), (111), and (112) are the portable terrorist reporting alert program unit (113), (114) and (115) are the LCD screens that display the terrorist/ or amber alert information

FIG. 29

(116) is the transmission point screen of terrorist information that needs to be remotely checked for workability (117) is the action of calling, via the Internet, of the terrorist alert and Amber Alerts.

alert transmission point computer by calling the URL number, which isolates that exact computer so as to activate its transmission screen from a remote monitoring computer (117-*a*) is the real time image of the what is being shown on the remote screen being transmitted back to the monitoring computer (118) is the remote CPU transfer computer (119) is remote PC control software (120) is the home base monitoring computer

FIG. 30

(121) is intelligence information sent to be distributed by TRAP system (122) pictures or information cleared for distribution and ready to be processed (123) receives pictures or information and prepares it by priority for nationwide dissemination (124) builds a website and uploads terrorist/amber information (125) the ISP uploads info to WWW (126) is data being transferred to airport concourse area (127) is the local wireless transmission of the website to the terrorist display LCD (129) shows all the units in the area displaying same information and using the Internet as an automatic rapid information dissemination tool (130) shows a person receiving vital terrorist information

FIG. 31

Figure 32:
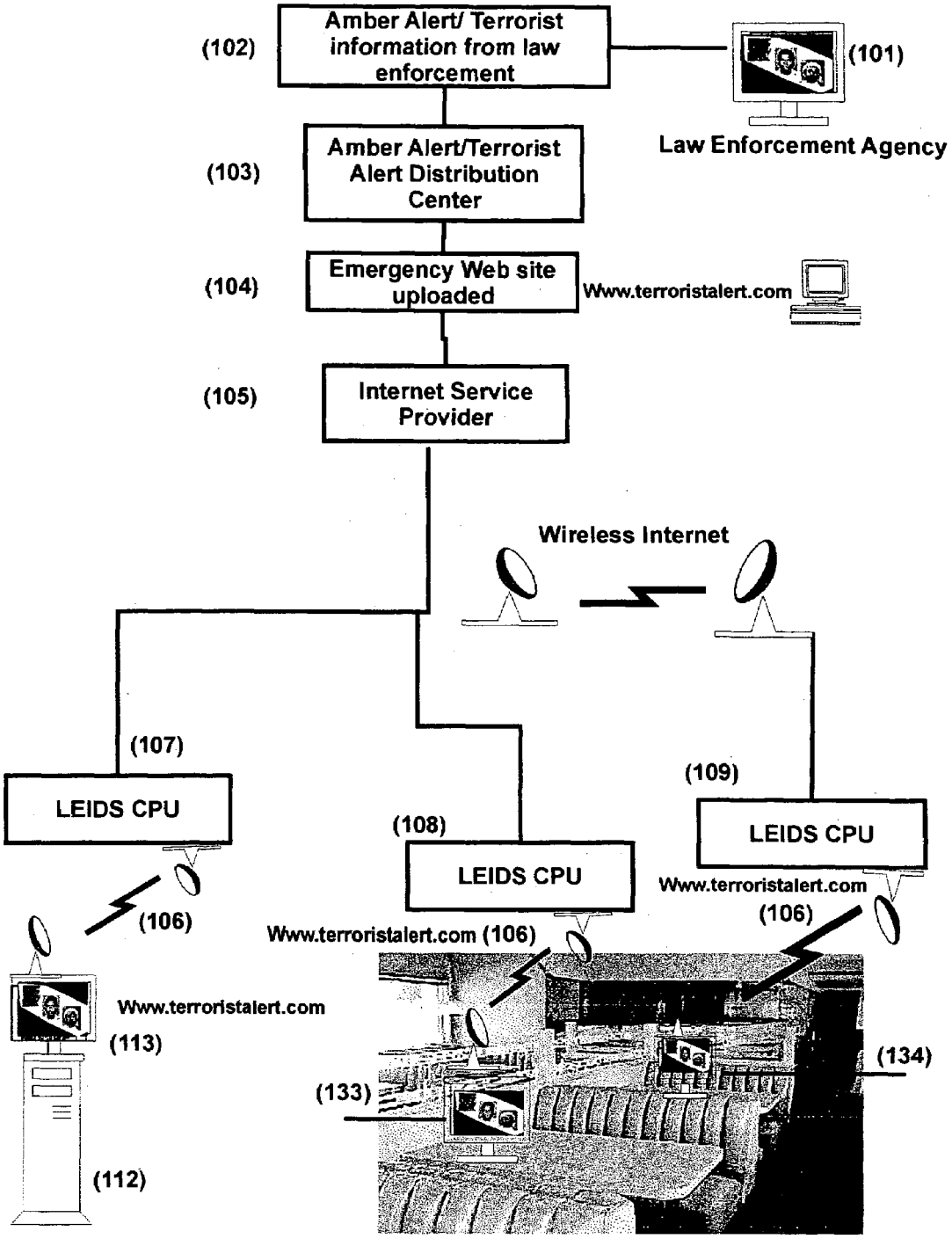

(131) shows an advertising sponsor using the dissemination system for promotion (132) shows a person seeing the sponsor ad's and the terrorist information FIG. 32—Shows the terrorist images being wirelessly disseminated to restaurant tables to portable table top LCD screens (133) and (134)

Figure 33:
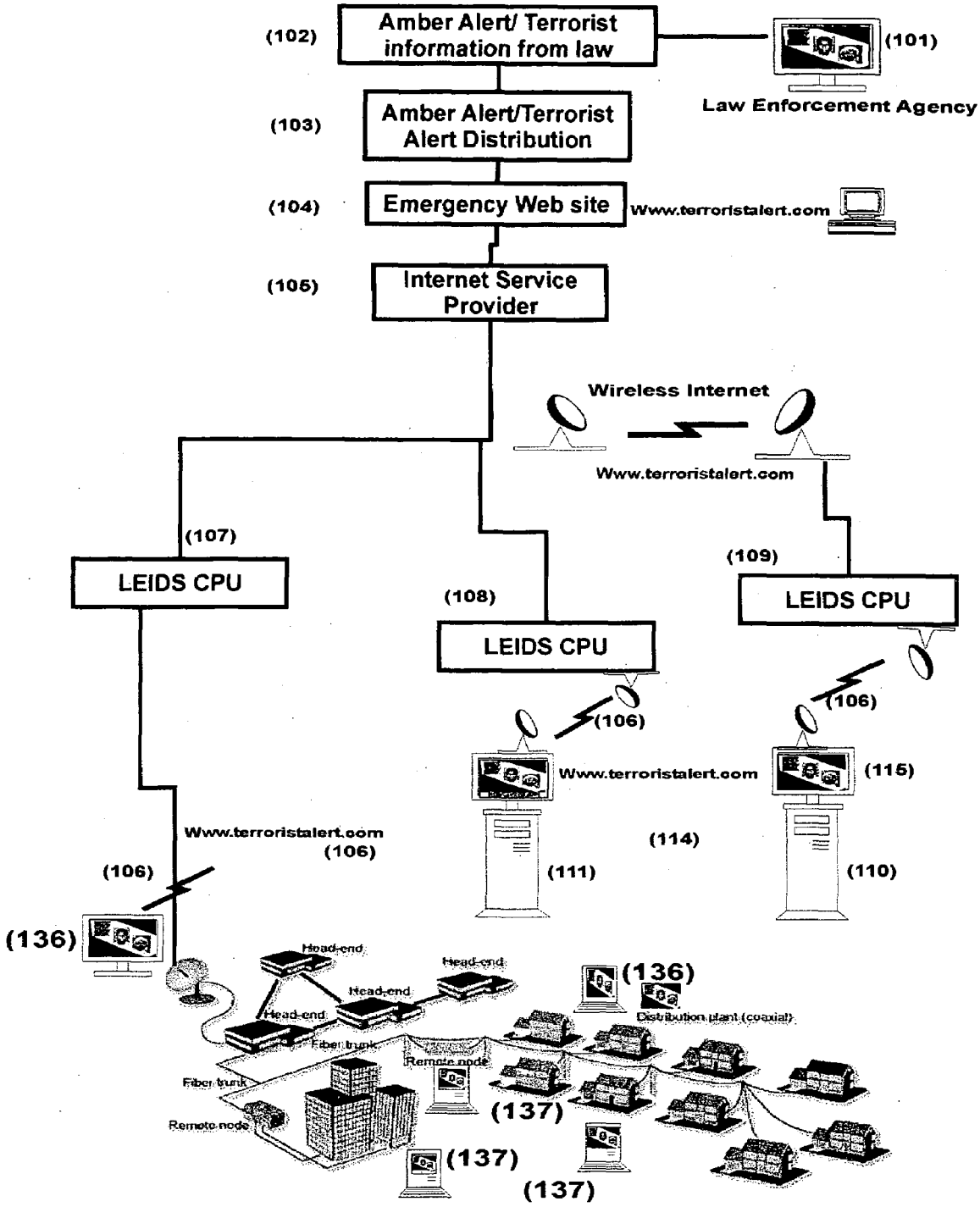

FIG. 33—Shows the use of the nations cable network stations (135) to further the wanted terrorist information (136) to cable stations for distribution to the general public (137) to their regional signal area.

Figure 34:
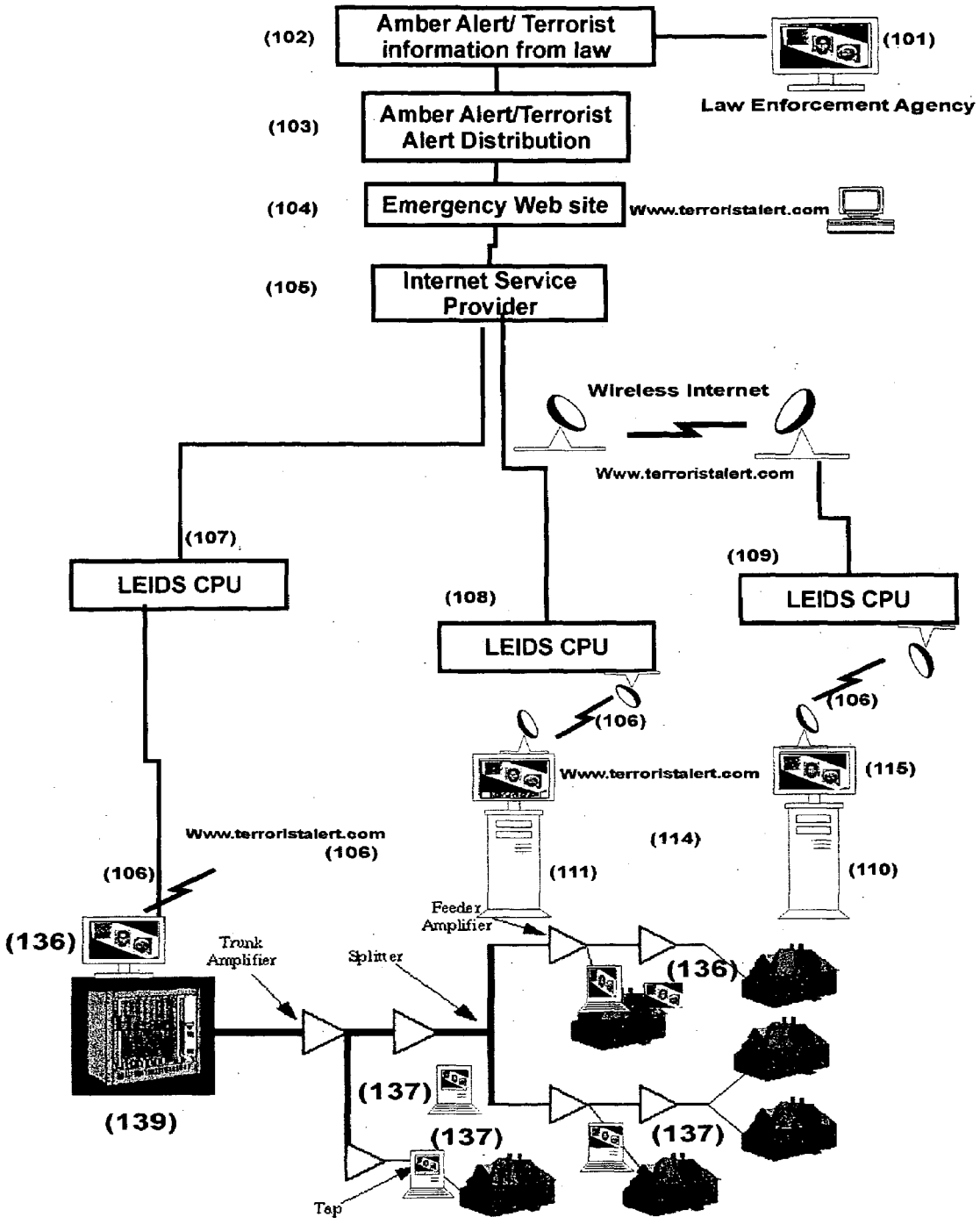

FIG. 34—Shows the Internet transmission being converted to audio and video output signals input into the head end of the cable network.

Figure 35:
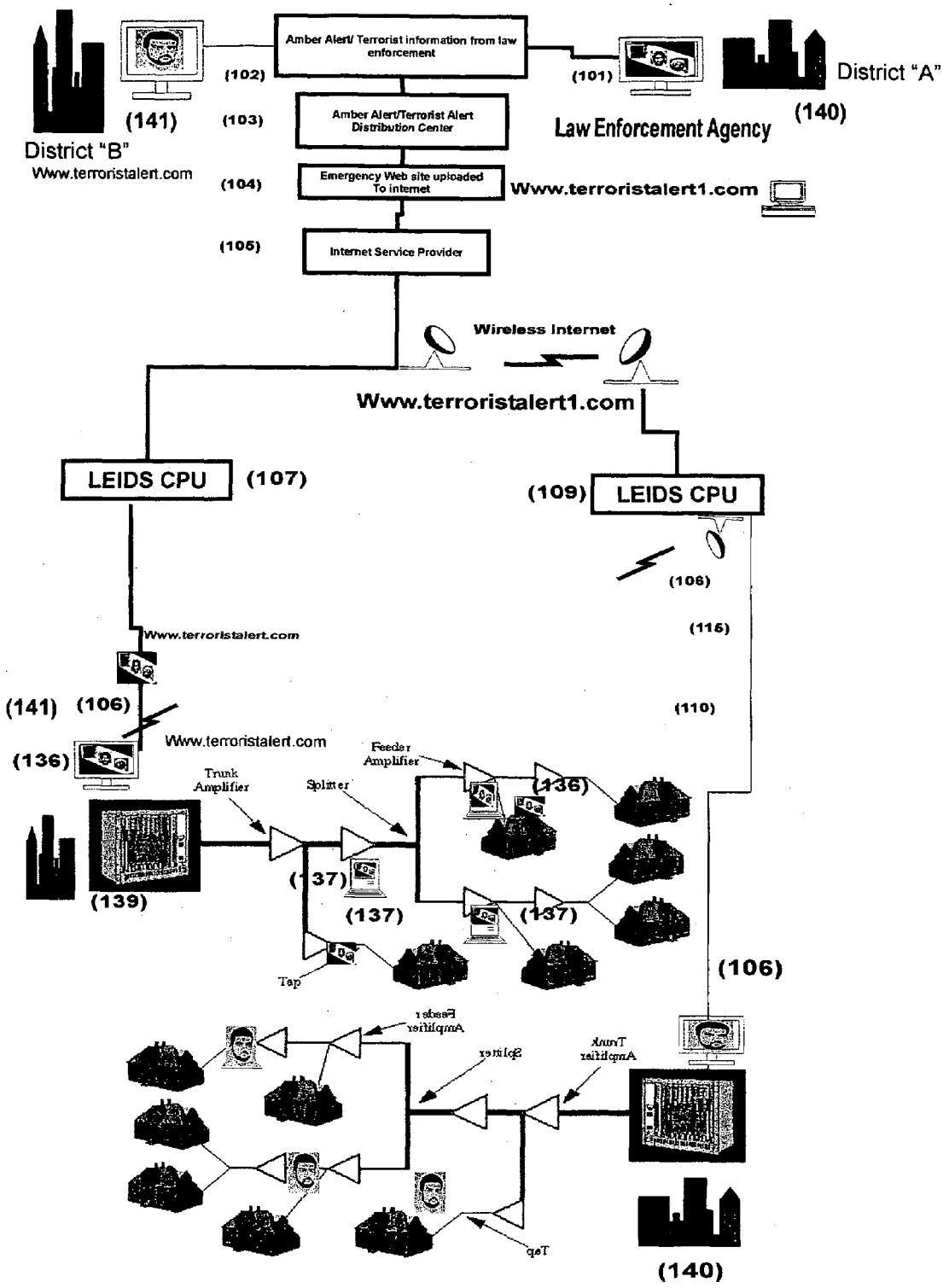

FIG. 35—Shows how different districts (140) and (141) can be supplied with selective information pertinent to the area.

Figure 36:
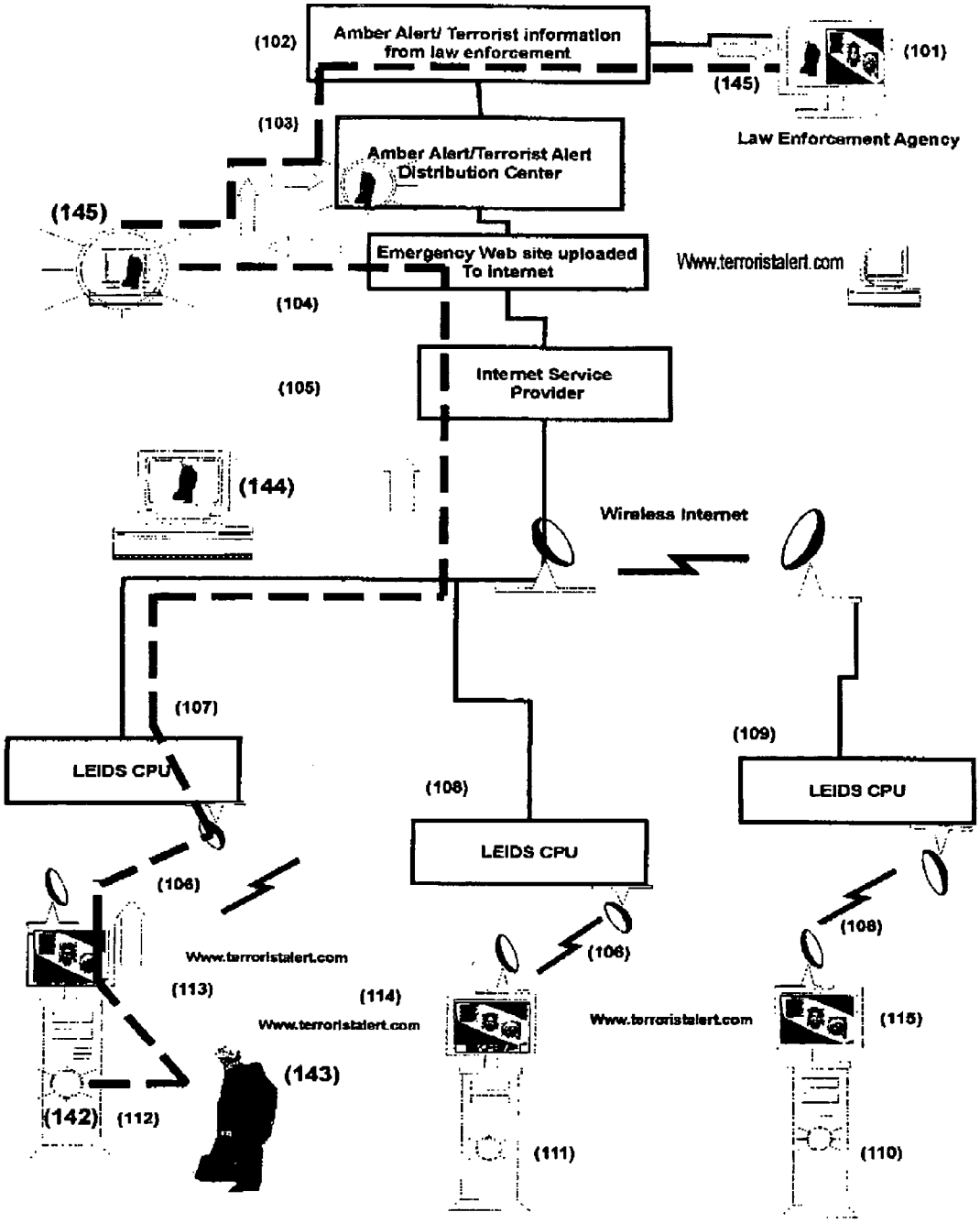

FIG. 36—Shows the built-in camera (142) that transmits the real-time images (143) in front of the image display units (112) that detects suspicious reactions to the wanted images being shown such as looking away from the images, walking away from the area, efforts to not be noticed by others in the crowd. The suspicious reactions are monitored by local security (144) officials as well as by other federal watchdog facilities (145).

Figure 37:
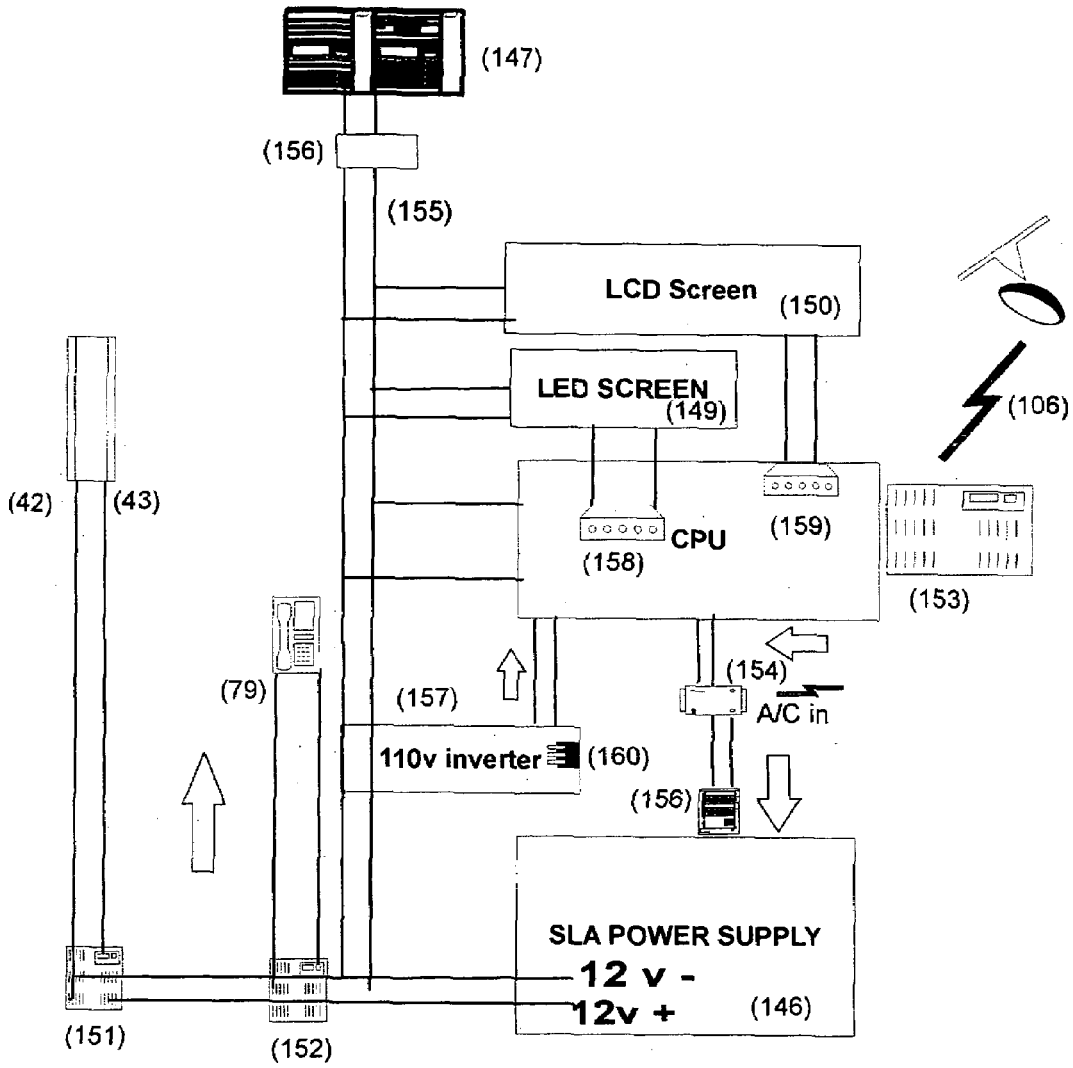

FIG. 37—Shows the components and wiring circuits for the portable LEIDS unit. (146) is a 12 volt high amp hour sealed lead acid battery. This battery operates (151) the e-911 wand recharging circuit that connects to the e-911 wand FIG. 9 (42) and (43) and (152) the Blue Line phone FIG. 22 (79) recharging circuit. (153) is the wireless receiver that receives transmissions from the wireless Internet transmission circuit (106). The 12 volt supply from (146) operates the LED screen (149) and the LCD screen (150). (154) is the A/C line in connection to provide recharging power to the LEIDS unit. (155) is the circuit that supplies the emergency cellular power unit (147). Ref. Utility Patent 10/134,541, filed Apr. 30, 2002, now abandoned (156) is the internal battery charger that recharges the SLA power supply (146). (157) is the 110 volt inverter that takes 12 volts and changes it into 110-volts during power outages at supply (154). (160) is the relay switch to convert over from outside power to 110 volt converted power at (157) converter when outage is detected at (154).

OPERATION OF THE SYSTEM

FIG. 1—Shows e-911/terrorist hotline calling wand. This wand is designed to be used by the general public for emergency purposes to contact either a terrorist hotline or place an e-911 call to summons help from authorities. Its structure is impact resistant, water resistant and made to be carried or passed over to other persons in extreme environments such as bombsites, earthquake sites, fire sites, etc.

FIG. 2

(2) shows a one-button e-911 hotline button that is designed to activate an e-911 tracking signal along with the voice calling and receiving capabilities of a normal 911 call.

(3) Shows a one button terrorist hotline button that sends a call to a preprogrammed terrorist hotline reporting center and sends an e-911 tracking signal as well.

(4) Shows the LCD readout that displays the call status as "connecting" or "connected" or "call ended".

(5) Is the negative recharging terminal and (6) is the positive terminal that connects to a charging block assembly (18) to keep the calling wand charged and ready for use.

(7) Is a reset button that resets the unit back to "ready" status after either an e-911 call or a terrorist hotline call (8) Shows the homeland security alert status beacon that illuminates the current homeland security status color code-Low-Green, Blue-Guarded, Yellow-Elevated, Orange-High, Red-Severe.

(9) Points to the structure of the wand which is made of strong, lightweight aluminum.

(10) Shows the switch for changing status alert colors

FIG. 3—Shows (14) the emergency cellular charging station—Ref Utility Patent Application 10/134,541 Apr. 30, 2002—PPA 60/328/057 PPA 60'328/019 PPA 60/327,916 #29/149,224

(11) Is the start switch that activates a timed charging cycle for the multiple model charging cords designed to supply portable emergency, cellular operating and recharging power to the most widely used cellular phones by the general public.

(12 Is the cellular re-charger D/C power recharging port that accepts a d/c power transformer that recharges the cellular the power supply in the emergency cellular charging station.

(13) Is the charging indicator light that shows power is reaching the portable cellular power supply battery (14) Is the overall view of the portable emergency cellular charger (15) Shows how the e-911 wand sliding out of housing for use.

FIG. 4

(17) shows the spring loaded electrical contact points fully extended. This spring pressure allows a strong electrical contact from the charging block power to the e-911 wand receipt contact points. The springs act as well as a means to quickly release the e-911 wand for use when the spring catch clips are released.

(18) Shows the spring loaded charging block structure fully depressed and ready for release when needed for use.

FIG. 5—Shows how the contacts meet to, supply recharging power to the e-911 wand (1) via the following points: (19) positive connection transfer point, (20) Is the negative connection transfer point (21) positive connection receipt point (22) negative connection receipt point.

FIG. 6—(24) shows hand pressure pushing the wand down to catch points (25) shows the springs extended and being depressed (26) shows the springs fully depressed and holding the wand down (27) shows the momentary pressure down to release the wand (28) shows the spring pressure pushing up to release the wand for use.

FIG. 7

(29) shows the e-911 wand coming out of the unit. (30) shows an internal illustration of wand action

FIG. 8

(31) shows the wand fully inserted in the cellular charging station and (32) shows an internal illustration of wand depressed inside.

FIG. 9—Shows the internal workings of the e-911 wand. (33) Shows the beacon lights for the for the Homeland Security color code status beacon. (34) is the internal switch to activate the correct the Homeland Security color-coded status alert. (35) Is the LCD call status panel (36) is the touch pad to reset the preprogrammed e-911 calls or terrorist hotline call. (37) Is the -e-911 auto programmed touch pad and (38) is terrorist hotline auto programmed touch pad. (39) Is a cellular transmitter and receiver (40) is back up battery 1 and (41) is back up battery 2. (42) is the negative contact bar (43) positive contact bar.

FIG. 10

(45) shows an e-911 wand in wall mounted enclosure and (46) is a wall mounted door latch.

FIG. 11

(47) shows the different auto dialer on touch buttons that can be used to call sponsors for commercial business. auto dial sponsor buttons. (48) Illustrates that the sponsor panel is located on the back side of e-911 wand.

FIG. 12

(49) shows the internal workings of the sponsor side of the e-911 wand touch pad system and the LCD readout. (50) Shows the internal action of the auto dial sponsor action against (51) touch pad for calling multiple sponsors (53) customer action to call sponsor external view

FIG. 13

(54) shows a side view of a customer action to call a sponsor by closing a switch to auto dial circuit auto dial circuit

FIG. 14

(56) sponsor advertisement (60) e-911 wand with sponsor autodial (61) e-911 instructions (62) customer removing the e-911 wand

FIG. 15

(59) customer removing the e-911 wand

FIG. 16

(60) reverse side of the e-911 wand with ad touch pad

FIG. 17

(61) beacon light displaying the current homeland security alert status color code

FIG. 18

(62) is the action of calling for help by pressing one button calling wand and (63) shows help arriving

FIG. 19

(64) (65) (66) (67) Shows various model cell phones and (69) Shows time wasted trying to figure out how to operate the phones (70) Shows a house on fire and (71) shows fire spreading due to too much time

FIG. 20

(72) shows the help arriving on time due to the one button e-911 call (75) shows the e-911 call being made without confusion (76) shows fast response and no wasted time in calling for help

FIG. 21

(75) shows electronic wanted poster displaying terrorist images (76) displays the current homeland security terrorist alert status (77) shows the built-in terrorist hotline for backup emergency calling

FIG. 22

(78) shows a wireless LED display for showing vital information (79) shows a wireless back reporting phone and terrorist hotline (80) shows the base and power supply housing (81) shows the e-911 wand (82) the homeland security status alert signage (83) LCD screen for displaying waned terrorist and amber alert information (14) is the emergency cellular charging unit FIG. 23—shows the applications for the terrorist reporting and alert units at an airport FIG. 24—shows the system in an airport (84) shows real time transmission of wanted terrorists being displayed in an airport (85) shows behind the scenes security monitoring of suspicious reactions to the pictures being displayed (86) shows a terrorist suspect having left the airport after seeing the visual display showing wanted terrorist (87) shows a law enforcement officer zeroing in on a fleeing terrorist (88) shows the changes in pictures being shown to the public (89) shows the terrorist awareness unit in detail (90) shows the public now being more aware of wanted people to look for

FIG. 25

(91) shows a terrorist suspect noticing the wanted terrorist pictures (92) shows the suspect in the suspicious reaction zone (93), and (94) shows the suspect leaving the area so as not to be detected (95) shows the suspect leaving the area so as not to be detected and being detained by security (96) shows the suspect being watched and identified by security (97) who calls officers to detain the suspect (98) shows federal watchdog authorities also monitoring the situation FIG. 26—Shows the intelligence coordination between various agencies in order to make wanted terrorist information available at key security points across the Nation FIG. 27—Shows the blue line security terrorist hotline for reporting suspicious activity (99) shows the blue line phone (100) shows the receipt points of the terrorist hotline at a federal watchdog point as well as local security personnel

FIG. 28

(101) shows law enforcement intelligence information being sent to an Intelligence clearance source (102)

(103) Intelligence is received by a terrorist/amber alert distribution center (104) an emergency website is updated for worldwide web distribution (105) Internet service provider sends out data to the Internet (106) shows the wireless Internet distribution of the information (107), (108), (109) are CPU's with wireless Internet transmission capabilities (110), (111), and (112) are the portable terrorist reporting alert program unit (113), (114) and (115) are the LCD screens that display the terrorist/or amber alert information

FIG. 29

(116) is the transmission point screen of terrorist information that needs to be remotely checked for workability (117) Is the action of calling, via the Internet, of the terrorist alert and amber alert transmission point computer by calling the URL number, which isolates that exact computer so as to activate its transmission screen from a remote monitoring computer (117-*a*) is the real time image of what is being shown on the remote screen being transmitted back to the monitoring computer (118) is the remote CPU transfer computer (119) is remote PC control software (120) is the home base monitoring computer

FIG. 30

(121) is intelligence information sent to be distributed by TRAP system (122) pictures or information cleared for distribution and ready to be processed (123) receives pictures or information and prepares it by priority for Nationwide dissemination (124) builds a website and uploads terrorist/amber information (125) the ISP uploads info to WWW (126) is data being transferred to airport concourse area (127) is the local wireless transmission of the website to the terrorist display LCD (128) is the remote CPU logged onto terrorist website (129) shows all the units in the area displaying same information and using the Internet as an automatic rapid information dissemination tool (130) shows a person receiving vital terrorist information

FIG. 31

(131) shows an advertising sponsor using the dissemination system for promotion (132) shows a person seeing the sponsor ad's and the terrorist information FIG. 32—shows the terrorist images being wirelessly disseminated to restaurant tables to portable table top LCD screens (133) and (134)

FIG. 33—Shows the use of the nations cable network stations (135) to further the wanted terrorist information (136) to cable stations for distribution to the general public (137) to their regional signal area.

FIG. 34—Shows the Internet transmission (106) being converted to audio and video Output signals then relayed from the head end (139) of the cable company onto the rest of the Cable network.

FIG. 35—Shows how different districts (140) and (141) can be supplied with selective information pertinent to the area.

FIG. 36—Shows the built-in camera (142) that transmits the real-time images (143) in front of the image display units (112) that detects suspicious reactions to the wanted images being shown such as looking away from the images, walking away from the area, efforts to not be noticed by others in the crowd. The suspicious reactions are monitored by local security(144) officials as well as by other federal watchdog facilities (145).

FIG. 37—Shows the components and wiring circuits for the portable LEIDS unit. (146) is a 12 volt high amp hour sealed lead acid battery. This battery operates (151) the e-911 wand recharging circuit that connects to the e-911 wand FIG. 9 (42) and (43) and (152) the Blue Line phone FIG. 22 (79) recharging circuit. (153) is the wireless receiver that receives transmissions from the wireless Internet transmission circuit (106). The 12 volt supply from (146) operates the LED screen (149) and the LCD screen (150). (154) is the A/C line in connection to provide recharging power to the LEIDS unit. (155) is the circuit that supplies the emergency cellular power unit (147). Ref. Utility Patent Application 10/134,541 Apr. 30, 2002 (156) is the internal battery charger that recharges the SLA power supply (146). (157) is the 110 volt inverter that takes 12 volts and changes it into 110-volts during power outages at supply (154). (160) is the relay switch to convert over from outside power to 110 volt converted power at (157) converter when outage is detected at (154).

DESCRIPTION

This invention offers a simple solution to several problems confronting the nation at this time. How can the various intelligence agencies remain co-coordinated in the dissemination of vital information in the fight against terrorism and get it to where it needs to be? How can the system be updated nationwide quickly? How can the systems be quickly installed? How can the nations e-911 emergency reporting system be enhanced and spread nationwide with the pay phone for emergency calling becoming more and more obsolete? How can the overloaded (due to terrorist reports ) 911 calling stations be lightened by providing a specific line for reporting terrorists activities. How can such a system be sponsored by the private sector? How can the general public become the additional eyes and ears of law enforcement for the purposes of spotting wanted terrorists or Amber alert suspects? How can the Homeland Security Alert statuses be quickly upgraded across the nation as well as provide further education to government employees and the general public on what the status changes mean and what actions are necessary to take? How can law enforcement agencies be given a new tool for monitoring large groups of people and isolate human emotions and reactions that are telltale and stand out for security and law enforcement officers to follow up on? How can portable emergency cellular power be made available to the general public for readiness and emergency communication support services? These important issues and many other factors make this vital new system of law enforcement a necessity and enhancement to our nations Homeland Security efforts that will greatly assist in the war on terrorism.

OBJECTS AND ADVANTAGES

How can the various intelligence agencies remain co-coordinated in the dissemination of vital information in the fight against terrorism and get it to where it needs to be? The present invention makes it possible for participating law enforcement agencies to subscribe to a public, wanted terrorist information network, that enables law enforcement agencies a way to immediately disseminate audio and visual wanted terrorist or other wanted suspects information, or other information needed for homeland security including cooperation or emergency procedures. This information can now be disseminated to the nations most vital and at risk locations in the nation. I.E Airport gates, customs check points, border patrol centers, seaports, stadiums, hotels, resorts, courthouses, national landmarks and governmental offices. The system utilizes the internet in a unique way. Using it as a public electronic wanted and emergency terrorist and homeland security alert status medium. Via a common website assembly center, each participating law enforcement agency is able to submit for publication their wanted terrorist or other vital security information. At the website assembly center FIG. 35 (104) a website is assembled with vital information plain to see and read or encoded as needed to send discreet messages to law enforcement agencies or security personnel at our nations most vulnerable sites. The start of the dissemination process starts at the law enforcement level (101-102) the information is screened for clearance to the Amber alert/terrorist alert distribution center (103)—The information is then sent to the website assembly center (104) where it is built into a website program with priority, color codes, audio signals and alarms, voice-overs, graphics enhancements and urgency levels as needed in order to get the proper response, result and action at the receipt points. (high risk gates, etc.,) From there the information is transferred to the Internet via an Internet service provider (105). The Internet via hardwire and satellite systems reaches a location where the transmission can be distributed as needed. FIG. 32 At the location the Internet signal is either directly connected by high speed cable or is distributed via a wireless internet transmitter and receiver (106). The information is now transmitted to an on board CPU which is programmed to log onto the special Internet website. This enables literally thousands of strategically located LEIDS—law enforcement information display system units, all logged onto the special website, to be instantly updated across the whole nation. This answers the first problem of: How can the various intelligence agencies remain co-coordinated in the dissemination of vital information in the fight against terrorism and get it to where it needs to be?

The next problem the invention answers is how can the information be updated all across the nation immediately? FIG. 35 (104) is the point where the information sources all across the country. It is at this point as well, specific regions, given different website log on addresses are sent "region-specific" information to be disseminated by law enforcement as needed. This system of regional distribution is shown in FIG. 35 (109) and (140). The next problem this invention solves is? How can the systems be quickly installed an how can they be strategically located so as to be seen both by potential terrorists in order to stimulate a suspicious reaction as well as by security personnel and the general public. FIG. 22 shows the completely portable LEIDS unit, that is fully equipped with a long duration rechargeable power supply (80) capable of powering the unit in a power outage situation or when needed in a completely portable situation, such as an overcrowded gate during flight delays or when needed in screening large groups during times of heightened alert status. FIG. 37 shows the portable circuitry that allows the unit to operate under it's own portable power. The next problem this invention solves is how can the nations e-911 emergency reporting system be enhanced and spread nationwide with the pay phone for emergency calling becoming more and more obsolete? Today the nation is faced with a growing problem. Pay phones are disappearing. A quick survey of populated places today shows that it is increasingly hard to find a pay phone in order to make an emergency phone call. The present invention makes e-911 public phones a very attractive and viable alternative to the disappearing pay phones.

FIG. 20 illustrates the solution to major problems facing society today. The disappearance of pay phones across the nation, (due to the cellular phone boon), greatly minimizes the points of emergency calling across the nation. The additional problem that faces the general public is the ever increasing complexity and the diversity of the cellular phones on the market. Because of the complexity of cellular phone operation, I.E. phone button locks, button send sequences, button identification, and additional features such as phone directories, games, visual aids, etc. FIG. (64)-(65)-(66)- and (67). For instance, in an emergency, if someone has to make a e-911 call then the time to call can be greatly delayed or completely thwarted if the cell phone is unfamiliar to the user, if the battery is dead, the phone is locked, by code, is "locked" by unfamiliarity or if it is unavailable altogether making it very difficult to make emergency calling a widespread problem. The answer to this problem is solved with the present invention in that the special new e-911 and terrorist hotline "calling wand" shown in FIGS. 1-21 shows how the problem can be solved nationwide. FIG. 20—shows how the simplicity of pushing one clearly marked button, can save time in summonsing help and can save property and lives by getting the message out without the confusion of what button to push. The calling wand also solves another growing problem in society. That problem is the fact that more and more terrorist reporting calls are being made to 911 calling facilities which are overburdening the 911 operators with calls that are not immediately life threatening but are still vital information calls. The solution to this problem is to provide a second "one touch" call button that calls a separate terrorist hotline which dramatically reduces the amount of 911 calls that should be more properly routed to a terrorist law enforcement r related agency instead. One of the major reasons pay phones are disappearing is the fact that they are no longer profitable to operate. The suggested embodiment in FIG. 14 shows how collective sponsors can pay for the distribution and operation of the units, allowing millions of former pay phone sites to be replaced with emergency calling sites that are not reliant on coin or credit card calls to be made to cover the cost of supplying a 911 call stations throughout the country. It should also be noted that the simplicity of the "one button" call feature allows children to be easily trained in it's use. Also physically impaired persons can more easily make a call as well by just having to press the button once. The unit can even be equipped with a voice activated feature, wherein a set sequence of numbers such as 9-1-1 can be spoken into the mouth piece so as to activate the call. Additionally, the calling wand is equipped with a long duration battery supply that allows hours of e-911 calling to be made in order to stay in communication in disastrous situations such as that experienced during the vents of 911. FIG. 9—(40) and (41). As is shown in the FIG. 12—an auto dial to the sponsors feature makes the calling wand an even more attractive feature to sponsors. However, it may be important in the future program the sponsor buttons with local emergency numbers such as Fire, Ambulance, Hospital, Police, EMT or others as an alternative to summons help if the 911 call line is over burdened as has happened in the past when a major incident has occurred. The sturdy structure of the wand FIG. 2-9 allows the storage of emergency chemical lighting glow sticks, for sending additional location help along with the all important e-911 tracking signals that sends out a GPS location enabling the emergency to be located by authorities without the need to actually give an address. Of course the address of the wand station is clearly marked on the station and a location number given each wand station that can be cross related to the location by authorities for automatic mapping computers to quickly print out directions to the emergency. The next problem the invention solves is how can the general public become the additional eyes and ears of law enforcement for the purposes of spotting wanted terrorists or Amber alert suspects? FIG. 24—(90) shows how the most wanted terrorists and other vital homeland security information including Amber Alerts is prominently displayed in highly populated locations throughout the country. Last year alone more than 440,000,000 people traveled through our nations top 50 airports. These units are placed on the main traffic channels of public locations and more specifically where people wait in line or wait at airport gates where the images and messages can be studied and absorbed by millions of people. It is quite commonly known that crimes are solved and criminals are caught when the information on who to look for is made available widely to the general public. The system of dissemination of information and the quick up load capability of the information makes this invention an extremely effective new tool in the fight on terror and crime in general, such as kidnappings, in the case of Amber Alert dissemination or even missing children alerts. How can the Homeland Security Alert statuses be quickly upgraded across the nation, as well as provide further education to government employees and the general public, on what the status changes mean and what actions are necessary to take? FIG. 21—(76) and FIG. 2—(82) shows a homeland security status color change and alert rating being shown on the LEIDS units. The information is programmed into the unit wirelessly along with all the other information via the wireless information system outlined in FIG. 34. How can law enforcement agencies be given a new tool for monitoring large groups of people and isolate human emotions and reactions that are telltale and stand out for security and law enforcement officers to follow up on? FIG. 24—(86-*a*) shows a track of a terrorist entering an airport and walking into a "people trap" (90). This people trap is how suspicious human emotion and reaction is stimulated in the terrorist. The crowd is informed continuously of wanted terrorists. A terrorist walks into the 'people trap".

Figure 25:
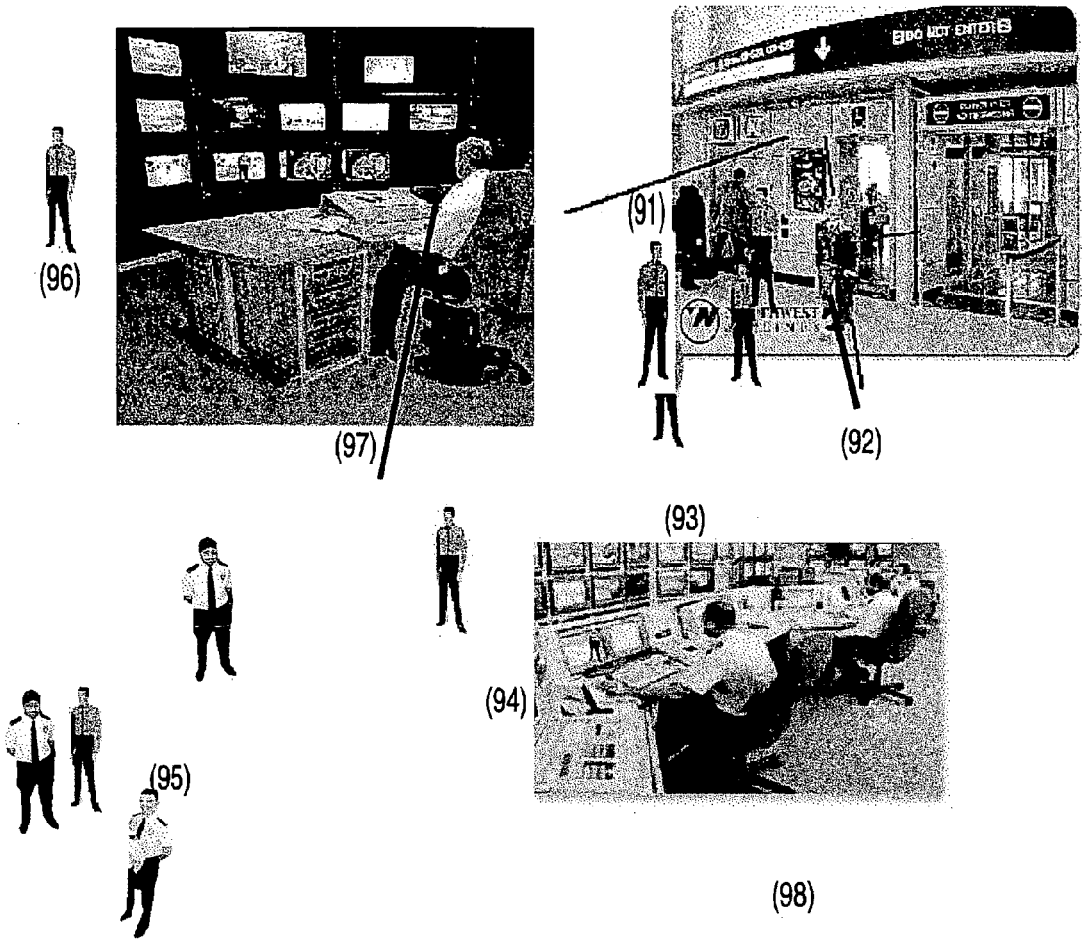

Real-time changes in terrorist images (88) and (89) leaves the terrorist wondering if his image will come up or whether his image has already come up and is fresh in the minds of the crowd. He becomes uncomfortable and leaves the line, acts suspicious, or creates diversion from the pictures. The suspicious reaction is monitored by security (85) and law enforcement personnel (86-*b*) are summoned to move in on the suspect. It has been proven many times that if you can get the information to the general public, you can greatly increase the chances of spotting suspicious reaction. The people trap can be set up wherever law enforcement officials deem it necessary. FIG. 23 shows how the LEIDS units can be placed wherever there are large groups of people that need to be informed and possible terrorists or wrong doers "flushed out". This systems works beautifully when tested as serves as means of not only setting the suspects on edge by keeping the general public informed on what to do, who to look for as well as adding millions of eyes to the hunt for suspicious activity in our nations most vulnerable public places. FIG. 25 shows local as well as federal remote monitoring of suspicious reactions that are brought about by the "People Trap". FIG. 26. shows how the terrorist is further set on edge by the fact that multiple agencies can in real time submit information. This furthers the possibilities that their face may come up and be seen. Right there, while they are there! When real time input is possible the terrorist will not be able to rest easy. This of course, is the magic in the effectiveness of the stimulus response, law enforcement, capabilities utilized in the "People Trap" anti -terrorism tool. The next vital need that this invention solves is How can portable emergency cellular power be made available to the general public for readiness and emergency communication support services?) Ref. Utility Patent Application 10/134,541 Apr. 30, 2002. This unique invention allows the general public to recharge their cellular phones while let us say at an airport. As is now common knowledge, cellular phones have been proven to be a very important tool for fighting the war on terror.

Ref: USA TODAY Oct. 23, 2001

By John Yaukey Gannett News Service

"The events of 911 demonstrated how helpful mobile phones can be in an emergency. There are numerous accounts of victims and survivors of the terrorist's attacks making critical calls to friends and family over cellular networks".

Ref. "Mustang Daily Online" Nov. 1, 2001 by Jenni Mintz "Cell phones also provide safety in an emergency, allowing people to contact help when they are far from a pay phone or society".

This invention is enhanced by the use of the portable cellular charging station in In this use, the e-911 calling wand is housed into the unit FIG. 3. (14). This provides detachable e-911 calling capability by using the e-911 wand. The main unit, is capable of charging over 70 models of the most widely used cellular phones which enables the public to charge their cellular phones for readiness, while out and about, and in emergency situations wherein the area is left without recharging power or conventional phone lines.

Upon review of this invention by law enforcement agencies it has been found to be a very much needed and wanted system that answers many problems the world faces today. Comments such as "theses should be in all federal courthouses", at the Super Bowl, at all the national monuments, etc". Essentially wherever there are large groups of people in high risk locations across the nation.

The invention claimed is:

1. A method of identifying suspicious persons, including wanted terrorists and criminals, by providing predetermined audio-visual stimuli in controlled public or private environments in order to elicit specific human responses, reactions and judgment changes in said suspicious persons, comprising the steps of:

(a) creating multiple stimuli points in said controlled environments for showing said predetermined audio-visual stimuli in the form of real-time intelligence regarding "wanted terrorists" to the general public including any said suspicious persons that may be present;

(b) providing a central audio-visual data storage and retrieval system accessible by at least one law enforcement agency for storing said "wanted terrorists" intelligence including images and information;

(c) providing a central processing center for retrieving, prioritizing and encoding said images and information so that said images and information act as an effective audio-visual stimulus for evoking at least one of said specific human responses and reactions;

(d) preparing the prioritized and encoded images and information in forms capable of being published on the Internet and on cable communication networks for distribution to predetermined high terrorist risk locations corresponding to said controlled environments;

(e) publishing the prioritized and encoded information on the Internet and on one or more cable communication networks;

(f) providing a portable apparatus and a stationary apparatus each of which displays said "wanted terrorists" images and information in a predetermined manner that evokes said specific human responses and reactions in said suspicious persons;

(g) monitoring and capturing said specific human responses and reactions on camera;

(h) using human surveillance to monitor and analyze said specific human responses and reactions;

(i) transmitting electronically said specific human responses and reactions to at least one remote location for security evaluation; and (j) remotely verifying the predetermined audio-visual stimuli being disseminated at said controlled environments.

2. A system for providing enhanced law enforcement capability and a collective public awareness environment through widespread public emergency communications, wherein the general public receives real-time information regarding suspicious persons, including wanted terrorists and criminals, in highly populated public locations that have been designated as high risk to terrorist attacks, comprising:

portable emergency display and recharging units strategically located at waiting areas and entrance areas of said high risk public locations, said unit each including a portable e-911 cellular calling wand, a portable cellular recharging device for said cellular calling wand, a backup emergency phone, and a display;

whereby the general public is able to use the calling wand to place e-911 calls or terrorist hotline calls, with a single press of a button, to security personnel at said public location and/or to remotely located federal authorities, and to use the backup phone to place emergency calls during a power outage; and wherein the display provides real-time images and information of said suspicious persons that evokes both (i) heightened awareness in the general public of their surroundings in the waiting areas and entrance areas regarding said suspicious persons, when the general public views the display, and (ii) discernable predetermined human responses and reactions in said suspicious persons, when said suspicious persons view the display; and wherein the display further provides the current homeland security terrorism alert status code.

* * * * *